US008442409B2

(12) United States Patent
Hirai et al.

(10) Patent No.: US 8,442,409 B2
(45) Date of Patent: May 14, 2013

(54) IMAGE FORMING APPARATUS INCLUDING A ROTATION MEMBER CIRCUMFERENCE CALCULATOR AND CONTROL METHOD THEREOF

(75) Inventors: Masahide Hirai, Numazu (JP); Yoshiro Saito, Susono (JP); Kazuhiro Funatani, Mishima (JP); Hiroyuki Seki, Mishima (JP); Tatsuya Kinukawa, Mishima (JP); Yasutaka Yagi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/443,226

(22) Filed: Apr. 10, 2012

(65) Prior Publication Data

US 2012/0195605 A1 Aug. 2, 2012

Related U.S. Application Data

(63) Continuation of application No. 12/470,628, filed on May 22, 2009, now Pat. No. 8,185,003.

(30) Foreign Application Priority Data

May 27, 2008 (JP) ..... 2008-138782

(51) Int. Cl.
*G03G 15/00* (2006.01)

(52) U.S. Cl.
USPC ..... 399/49

(58) Field of Classification Search ..... 399/49, 399/308, 302
See application file for complete search history.

(56) References Cited

U.S. PATENT DOCUMENTS 5,499,092 A 3/1996 Sasaki
6,493,533 B1 12/2002 Munakata
6,658,221 B2 12/2003 Hama et al.
6,909,858 B2 6/2005 Hama et al.
6,985,678 B2 1/2006 Maebashi et al.
7,058,323 B2 6/2006 Maeyama et al.

(Continued)

FOREIGN PATENT DOCUMENTS

CN 1083646 A 3/1994
JP 2-297006 A 12/1990

(Continued)

OTHER PUBLICATIONS

Communication dated Aug. 14, 2009, forwarding a Search Report in counterpart European Application No. 09158797.2-1240.

(Continued)

*Primary Examiner* — Quana M Grainger
(74) *Attorney, Agent, or Firm* — Fitzpatrick, Cella, Harper & Scinto

(57) ABSTRACT

There is provided an image forming apparatus including a rotation member used for image forming and a detector for detecting light from the rotation member. First waveform data of an image-formed surface used to form an image on the rotation member is acquired by the detector. Second waveform data of the image-formed surface used to form an image on the rotation member is acquired. The second waveform data includes at least part of a detected section of the first waveform data. Information on the actual circumference of the rotation member is calculated based on matching between the acquired first and second waveform data. The acquired first waveform data and second waveform data are compared to determine whether or not to use the calculated information on the circumference. When it is determined not to use the calculated information on the circumference, information on the circumference of the rotation member is recalculated.

12 Claims, 22 Drawing Sheets

U.S. PATENT DOCUMENTS

| | | | |
|---|---|---|---|
| 7,072,597 | B2 | 7/2006 | Shimura et al. |
| 7,535,580 | B2 | 5/2009 | Matsuoka |
| 7,953,334 | B2 | 5/2011 | Shida |
| 8,185,003 | B2 | 5/2012 | Hirai et al. |
| 8,264,733 | B2 | 9/2012 | Hanashi et al. |
| 2004/0105691 | A1 | 6/2004 | Hama et al. |
| 2005/0286918 | A1 | 12/2005 | Maeyama et al. |
| 2007/0036568 | A1 | 2/2007 | Shida |
| 2007/0231021 | A1 | 10/2007 | Kinoshita et al. |
| 2007/0237533 | A1 | 10/2007 | Hanashi et al. |
| 2007/0247636 | A1 | 10/2007 | Matsuoka |
| 2009/0296147 | A1 | 12/2009 | Kinukawa et al. |
| 2009/0297190 | A1 | 12/2009 | Kinukawa et al. |
| 2009/0297191 | A1 | 12/2009 | Hirai et al. |
| 2012/0195605 | A1 | 8/2012 | Hirai et al. |

FOREIGN PATENT DOCUMENTS

| | | | |
|---|---|---|---|
| JP | 5-215532 | A | 8/1993 |
| JP | 10-164003 | A | 6/1998 |
| JP | 10-288880 | A | 10/1998 |
| JP | 11-038707 | A | 2/1999 |
| JP | 2000-162833 | A | 6/2000 |
| JP | 2002-214854 | A | 7/2002 |
| JP | 2004-85711 | A | 3/2004 |
| JP | 2005-148299 | A | 6/2005 |
| JP | 2005-189494 | A | 7/2005 |
| JP | 2006-10826 | A | 1/2006 |
| JP | 2006-15062 | A | 1/2006 |
| JP | 2006-126448 | A | 5/2006 |
| JP | 2006-150627 | A | 6/2006 |
| JP | 2007-279523 | A | 10/2007 |
| JP | 2007-283721 | A | 11/2007 |
| JP | 2009-288351 | A | 12/2009 |
| JP | 2010-8804 | A | 1/2010 |
| JP | 2010-9018 | A | 1/2010 |
| JP | 2010-26102 | A | 2/2010 |
| JP | 2010-39126 | A | 2/2010 |

OTHER PUBLICATIONS

Notification of the First Office Action dated Mar. 2, 2011, in Chinese Application No. 200910145658.0.

Notification of Reasons for Refusal issued Oct. 12, 2012, in Japanese Application No. 2008-138782.

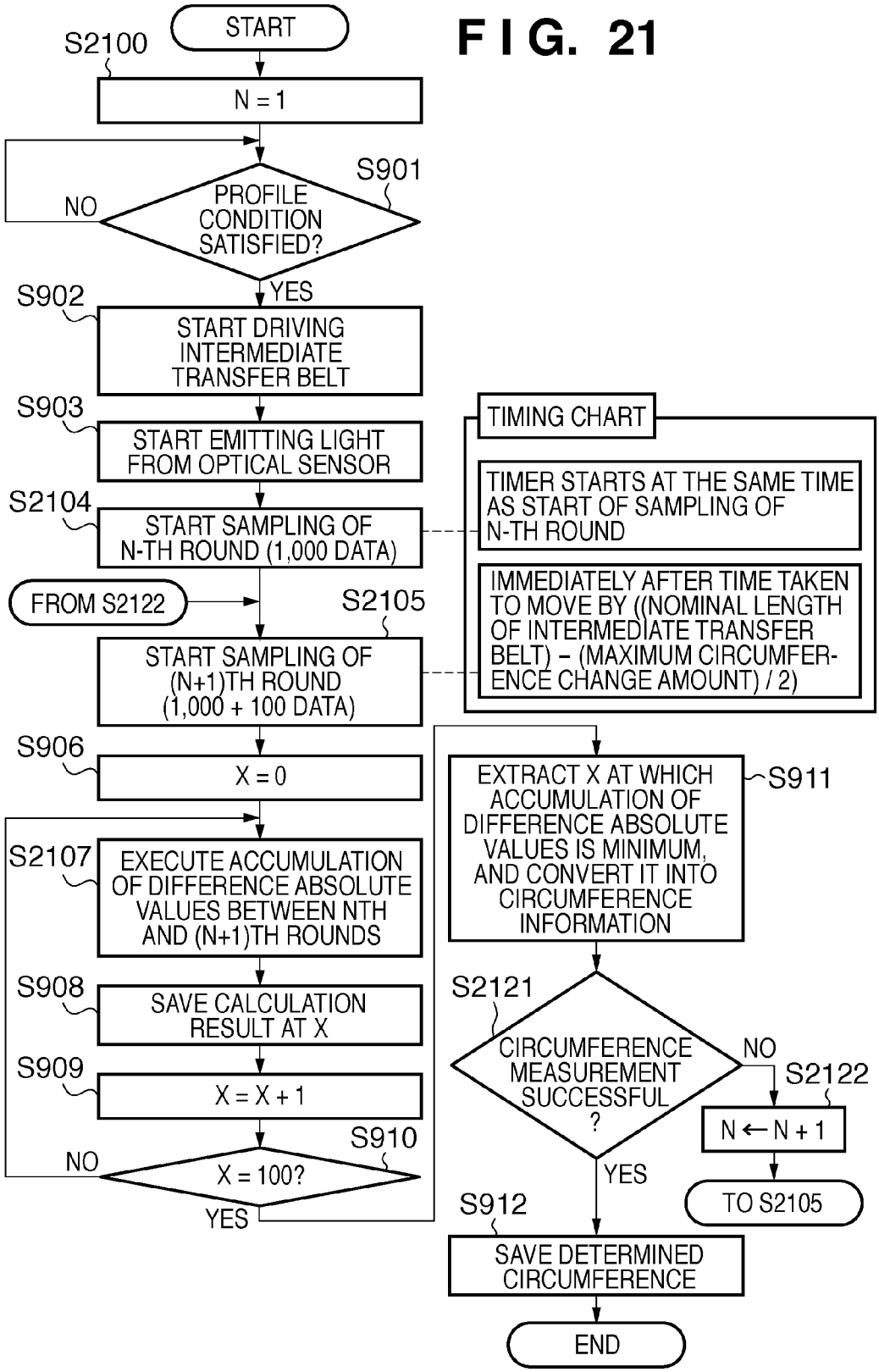
FIG. 21
START
S2100
N = 1
S901
PROFILE CONDITION SATISFIED?
NO
YES
S902
START DRIVING INTERMEDIATE TRANSFER BELT
S903
START EMITTING LIGHT FROM OPTICAL SENSOR
S2104
START SAMPLING OF N-TH ROUND (1,000 DATA)
TIMING CHART
TIMER STARTS AT THE SAME TIME AS START OF SAMPLING OF N-TH ROUND
IMMEDIATELY AFTER TIME TAKEN TO MOVE BY ((NOMINAL LENGTH OF INTERMEDIATE TRANSFER BELT) − (MAXIMUM CIRCUMFERENCE CHANGE AMOUNT) / 2)
FROM S2122
S2105
START SAMPLING OF (N+1)TH ROUND (1,000 + 100 DATA)
S906
X = 0
S2107
EXECUTE ACCUMULATION OF DIFFERENCE ABSOLUTE VALUES BETWEEN NTH AND (N+1)TH ROUNDS
S908
SAVE CALCULATION RESULT AT X
S909
X = X + 1
S910
X = 100?
NO
YES
EXTRACT X AT WHICH ACCUMULATION OF DIFFERENCE ABSOLUTE VALUES IS MINIMUM, AND CONVERT IT INTO CIRCUMFERENCE INFORMATION
S911
S2121
CIRCUMFERENCE MEASUREMENT SUCCESSFUL ?
NO
S2122
N ← N + 1
TO S2105
YES
S912
SAVE DETERMINED CIRCUMFERENCE
END

IMAGE FORMING APPARATUS INCLUDING A ROTATION MEMBER CIRCUMFERENCE CALCULATOR AND CONTROL METHOD THEREOF

This application is a continuation of U.S. patent application Ser. No. 12/470,628; filed May 22, 2009.

BACKGROUND OF THE INVENTION

1. Field of the Invention

The present invention relates to an image forming apparatus such as a copying machine, printer, or facsimile apparatus which forms an image by an electrophotographic method, and a control method thereof.

2. Description of the Related Art

These days, image forming apparatuses using the electrophotographic method are achieving higher speeds and higher qualities. In particular, color image forming apparatuses require accurate color reproduction and tint stability, and generally have a function of automatically controlling the image density.

In image density calibration control, an image density detector incorporated in an image forming apparatus detects a plurality of test toner images (patches) which are formed on an image carrier while changing image forming conditions. The detected toner images are converted into a substantial amount of toner adhesion, and optimum image forming conditions are determined based on the conversion result.

A plurality of types of image density calibration control operations is generally executed to obtain optimum values for a plurality of types of image forming conditions. The types of image forming conditions include conditions such as the charging voltage, exposure intensity, and developing voltage, and a lookup table setting used to convert a signal input from the host into output image data when forming a halftone image. The tint varies depending on a change of the environment where an image forming apparatus is used, the use log of various consumables, and the like. The image density calibration control needs to be periodically executed to always stabilize the tint.

According to the detection principle of an optical image density detector, a light receiving element receives light which is emitted from a light emitting element and reflected by a patch or image carrier itself. The amount of toner adhered to the patch is calculated from the received light. Conversion into a substantial amount of toner adhesion is executed based on the relationship between an output from the light receiving element when no toner is adhered to the image carrier, and an output from the light receiving element when toner is adhered to the image carrier.

The reflectance of the image carrier surface changes depending on the position of the image carrier. To calculate the amount of toner adhesion at high precision, outputs in the presence and absence of toner need to be acquired at the same position on the image carrier. In general, a background output VB from the light receiving element in the absence of toner is acquired at a specific position. Then, the image carrier rotates at least one round. A patch is formed at the same position to acquire a patch output VP from the light receiving element. The background output VB corresponds to light reflected by the background of the image carrier. The patch output VP corresponds to light reflected by the patch. Specifying the position on the image carrier requires the circumference of the image carrier. This is because the time taken for a specific position on the image carrier to rotate is obtained by dividing the circumference by the circumferential speed (process speed) of the image carrier.

However, the circumference of the image carrier changes depending on variations of components, the environment of the image forming apparatus, and the like. If the circumference is used as a fixed value, an error occurs in specifying a position. To prevent this, information on the circumference of the image carrier needs to be measured dynamically.

Japanese Patent Laid-Open No. 10-288880 proposes the following method for an image forming apparatus which employs an intermediate transfer method. More specifically, a mark is attached to the surface of an intermediate transfer member. An optical sensor receives light reflected by the mark to measure the circumference of an image carrier. The mark is attached not to an image-formed surface used for image formation, but to a longitudinal end on the intermediate transfer member.

Japanese Patent Laid-Open No. 2006-150627 proposes a method of measuring the circumference of an electrostatic attraction belt in an image forming apparatus which adopts a direct transfer method. More specifically, according to the method disclosed in Japanese Patent Laid-Open No. 2006-150627, a patch is formed immediately below an optical image density detector. The optical image density detector measures the circumference of a target electrostatic attraction belt.

However, the conventional techniques suffer the following problems. For example, in the image forming apparatus in Japanese Patent Laid-Open No. 10-288880 that adopts the intermediate transfer method, the intermediate transfer member needs to rotate up to the mark set position, and further rotate one round. This is because when measurement of the circumference starts, the mark is not always positioned near the optical sensor. In the worst case, no circumference can be detected unless the intermediate transfer member rotates almost two rounds. A long circumference measurement time prolongs the period (so-called downtime) during which no image can be formed, impairing usability.

Even if usability can be maintained, the cost rises owing to an optical detection mark and optical sensor for measuring the circumference of an intermediate transfer member, as described above.

The image forming apparatus disclosed in Japanese Patent Laid-Open No. 2006-150627 forms a circumference measurement patch, consuming a larger amount of toner, compared to a case wherein no patch is formed. For the user, it is desirable to save toner as much as possible. In some cases, cleaning may take a long time.

Further, for example, immediately after activation upon return from a jam, the image carrier may travel unstably. In this case, the positional relationship between the circumference detection mark and the light receiving element changes, and the received light quantity varies between rounds. The image carrier circumference measurement method in Japanese Patent Laid-Open No. 10-288880 cannot obtain an accurate quantity of received light out of reflected light until traveling of the belt stabilizes. As a result, erroneous circumference information may be detected. Owing to even another factor, erroneous circumference information of the image carrier may be detected. If image density calibration control or the like is done based on the erroneous circumference information of the image carrier, no accurate image density calibration control result can be attained.

SUMMARY OF THE INVENTION

The present invention has been made to overcome the conventional drawbacks, and provides an image forming apparatus which measures a circumference while shortening the time taken for circumference detection and reducing the amount of toner used, and avoids detecting erroneous circumference information, and a control method thereof.

To solve the above-described problems, the present invention provides an image forming apparatus comprising a rotation member which is used for image forming or carries a printing medium and a detector adapted to detect light from the rotation member, the apparatus comprising: a first acquisition unit adapted to acquire first waveform data of a surface of the rotation member based on detection by the detector; a second acquisition unit adapted to acquire second waveform data of the surface of the rotation member based on detection by the detector, the second waveform data being detected from at least part of a detected section of the surface of the rotation member on which the first waveform data has been detected; a calculator adapted to calculate information on a circumference of the rotation member based on matching between the acquired first waveform data and second waveform data; and a determination unit adapted to determine whether or not to use the calculated information on the circumference by comparing the acquired first waveform data and second waveform data, wherein when the determination unit determines not to use the calculated information on the circumference, the calculator recalculates information on the circumference of the rotation member.

The present invention also provides a method of controlling an image forming apparatus comprising a rotation member which is used for image forming or carries a printing medium and a detector adapted to detect light from the rotation member, the method comprising: a first acquisition step of acquiring first waveform data of a surface of the rotation member based on detection by the detector; a second acquisition step of acquiring second waveform data of the surface of the rotation member based on detection by the detector, the second waveform data being detected from at least part of a detected section of the surface of the rotation member on which the first waveform data has been detected; a calculation step of calculating information on a circumference of the rotation member based on matching between the acquired first waveform data and second waveform data; and a determination step of determining whether or not to use the calculated information on the circumference by comparing the acquired first waveform data and second waveform data, wherein in the calculation step, when not to use the calculated information on the circumference is determined in the determination step, information on the circumference of the rotation member is recalculated.

The present invention further provides a computer-readable storage medium storing a program for causing a computer to execute steps of the above method of controlling the image forming apparatus.

The present invention can provide an image forming apparatus which measures a circumference while shortening the time taken for circumference detection and minimizing the amount of toner used, and avoids detecting erroneous circumference information, and a control method thereof.

Further features of the present invention will be apparent from the following description of exemplary embodiments with reference to the attached drawings.

BRIEF DESCRIPTION OF THE DRAWINGS

FIG. 21 is a flowchart showing an example of a remeasurement sequence upon a circumference measurement failure according to the third embodiment.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

The first embodiment will be explained with reference to FIGS. 1 to 15. In the first embodiment, the present invention is applied to a color image forming apparatus. The present invention is also applicable to a monochrome image forming apparatus. The image forming apparatus is, for example, a printer, copying machine, multi-functional peripheral, or facsimile apparatus. The first embodiment will exemplify an intermediate transfer method. The intermediate transfer method forms a toner image on a drum-like image carrier, preliminarily transfers the toner image to an intermediate transfer member (intermediate transfer belt), and secondarily transfers the toner image from the intermediate transfer member to a printing material. The printing material is also called, for example, a transfer material, printing medium, paper, sheet, or transfer paper.

[Image Forming Apparatus System]

Figure 1:
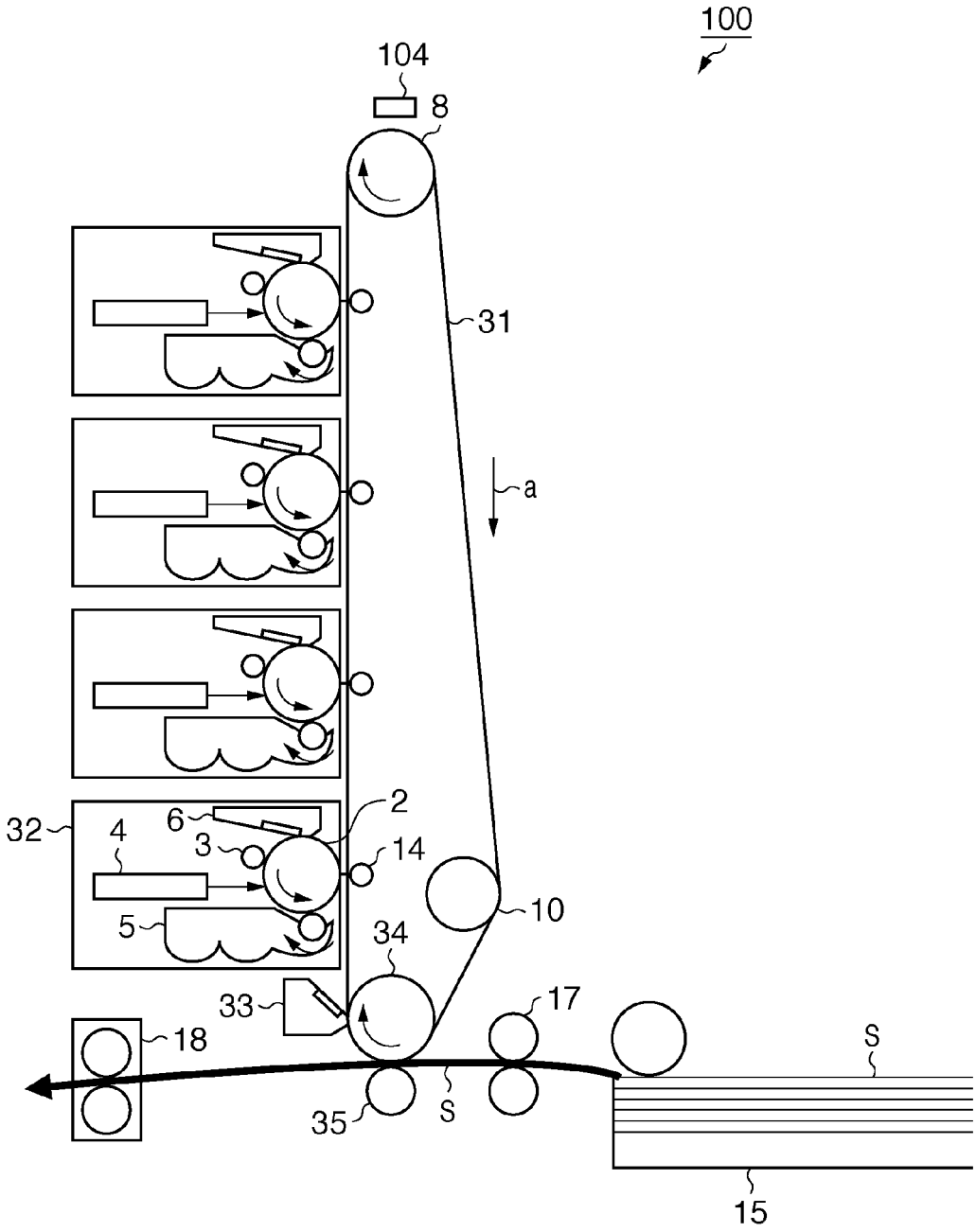
FIG. 1 is a schematic sectional view of a color image forming apparatus according to the first embodiment.

FIG. 1 is a schematic sectional view of a color image forming apparatus according to the first embodiment. The color image forming apparatus includes four image forming stations corresponding to Y (Yellow), M (Magenta), C (Cyan), and Bk (Black) toners. For descriptive convenience, the image forming stations have a common arrangement except for the color of the developer (toner).

Each process cartridge 32 includes a photosensitive drum 2, charger 3, exposure unit 4, developing unit 5, and cleaning blade 6. Toner images of different colors formed by the process cartridges (image forming stations) 32 are primarily transferred in series onto an intermediate transfer belt 31 by primary transfer rollers 14. The intermediate transfer belt 31 is an example of a rotation member used for image formation. A secondary transfer roller 35 secondarily transfers, onto a printing material S, a multicolor image formed on the intermediate transfer belt 31. The printing material S is conveyed from a paper feed unit 15. Then, a fixing unit 18 fixes the multicolor image onto the printing material S. A cleaner 33 recovers toner left on the intermediate transfer belt 31.

The photosensitive drum 2 is a rotary drum type electrophotographic photosensitive body used repetitively. The photosensitive drum 2 is driven to rotate at a predetermined circumferential speed (process speed). The process speed is, for example, 180 mm/sec. The primary charging roller of the primary charger 3 uniformly charges the photosensitive drum 2 to a predetermined polarity and potential. The exposure unit 4 includes a laser diode, polygon scanner, lens unit, and the like. The exposure unit 4 exposes the photosensitive drum 2 to an image, forming an electrostatic latent image on the photosensitive drum 2.

The developing unit 5 executes developing processing to adhere toner to an electrostatic latent image formed on the image carrier. The developing roller of the developing unit 5 is arranged in contact with the photosensitive drum 2 while rotating in the forward direction with respect to the photosensitive drum 2.

A driving roller 8 drives the intermediate transfer belt 31 to rotate in contact with the respective photosensitive drums 2 at almost the same circumferential speed as that of the photosensitive drums 2. The intermediate transfer belt 31 is formed from, for example, an endless film member about 50 to 150 μm thick at a volume resistivity of, for example, 10E8 to 10E12 Ωcm. For example, an image-formed surface (to be referred to as a surface hereinafter) used for image formation on the intermediate transfer belt 31 has a relatively high reflectance for black. The intermediate transfer belt 31 expands and contracts in accordance with the tolerance (about ±1.0 mm with respect to an ideal dimension value) in manufacturing the belt, and variations dependent on the temperature and humidity of the use environment (the intermediate transfer belt 31 varies by about 5 mm in an environment of 15° C. and 10% to that of 30° C. and 80%). However, a tension roller 10 keeps the intermediate transfer belt 31 taut, so the intermediate transfer belt 31 can rotate normally even if the circumference varies.

The primary transfer roller 14 is a solid rubber roller whose resistance is adjusted to 10E7 to 10E9Ω. The cleaning blade 6 removes and recovers toner left on the photosensitive drum 2 after primary transfer.

The printing material S fed from the paper feed unit 15 is conveyed toward the nip between the intermediate transfer belt 31 and the secondary transfer roller 35 by a pair of registration rollers 17 driven to rotate at a predetermined timing. A toner image on the intermediate transfer belt 31 is transferred to the printing material S by the action of static electricity generated by a high voltage applied to the secondary transfer roller 35.

[Control Arrangement of Image Forming Apparatus]

Figure 2:
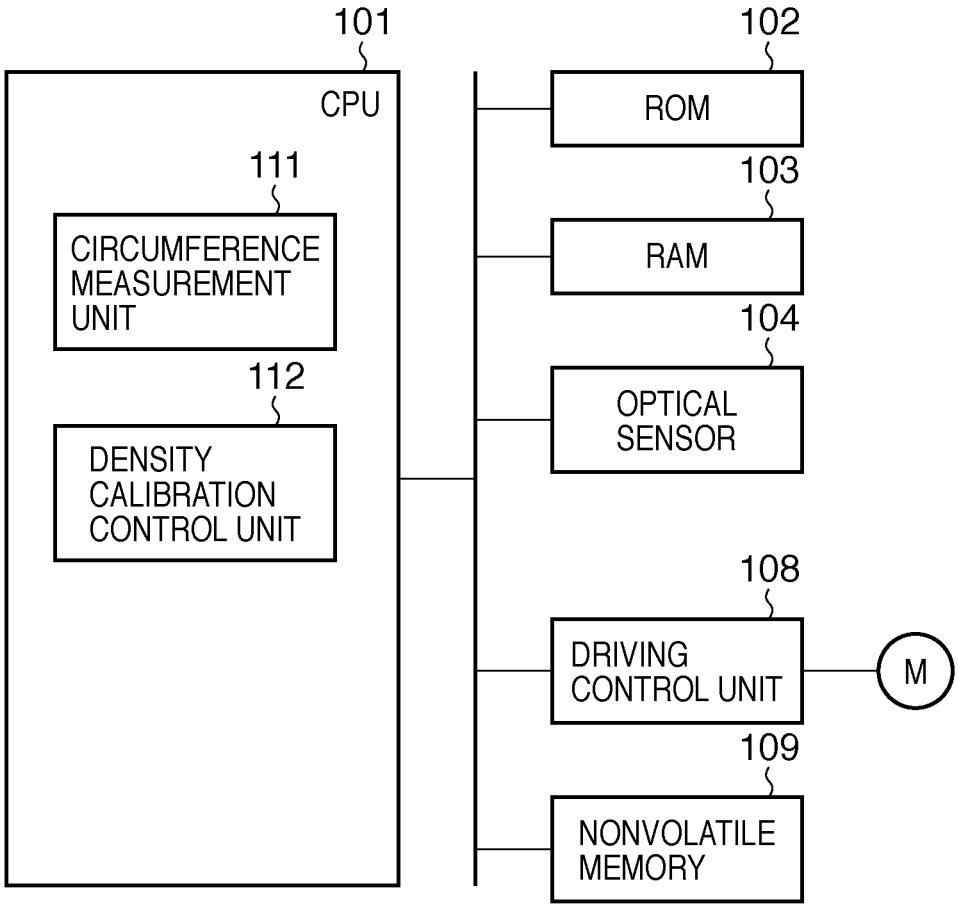
FIG. 2 is a block diagram showing an example of a control unit according to the first embodiment.

FIG. 2 is a block diagram showing an example of a control unit according to the first embodiment. A CPU 101 controls each unit of the image forming apparatus based on a variety of control programs stored in a ROM 102 by using a RAM 103 as a work area. The ROM 102 stores various control programs, various data, tables, and the like. The RAM 103 provides a program loading area, a work area for the CPU 101, various data storage areas, and the like. As characteristic functions, the CPU 101 in FIG. 2 includes a circumference measurement unit 111 and density calibration control unit 112.

A driving control unit 108 controls motors for driving the photosensitive drum 2, charger 3, exposure unit 4, developing unit 5, and intermediate transfer belt 31, and the charging bias, developing bias, and the like in accordance with instructions from the CPU 101.

A nonvolatile memory 109 is a storage which saves a variety of data such as light quantity setting data and information associated with the circumference of the intermediate transfer belt 31 which are used to execute image density calibration control.

The circumference measurement unit 111 measures the circumference of the intermediate transfer belt 31 based on data acquired by an optical sensor 104 from the intermediate transfer belt 31. The circumference measurement unit 111 is an example of a calculator which calculates information associated with the actual circumference of a rotation member. Information associated with the actual circumference means information for graphing the circumference of a rotation member that varies owing to any cause. This information is necessary to specify/detect, after a certain time, the same position as a given position at a given timing while the rotation member rotates. An example of this information is a length ($X_{profile\ result}$ to be described later) by which the rotation member expands or contracts over time from the nominal circumference (ideal dimension value free from any manufacturing tolerance or environmental variations) of the rotation member. Another example is actual circumference information (actual circumference given by equation (3) to be described later) of one round of the rotation member. The entity of the information may also be digital data (count value) representing the time, or digital data (count value) representing the length.

The density calibration control unit 112 adjusts image forming conditions using the quantity of light reflected by a patch image that is acquired using the optical sensor 104 for density calibration control, and obtained information associated with the actual circumference of the intermediate transfer belt 31.

The first embodiment will exemplify a case wherein the CPU 101 executes circumference measurement and density calibration control. However, the present invention is not limited to this. For example, when an image forming apparatus incorporates an ASIC (Application Specific Integrated Circuit) or SOC (System On Chip), the ASIC or SOC may also execute part or all of circumference measurement processing and density calibration control processing. The SOC is a chip which integrates a CPU and ASIC into a single package. When the ASIC executes circumference measurement and density calibration control, this can reduce the processing load on the CPU 101.

[Optical Sensor]

Figure 3:
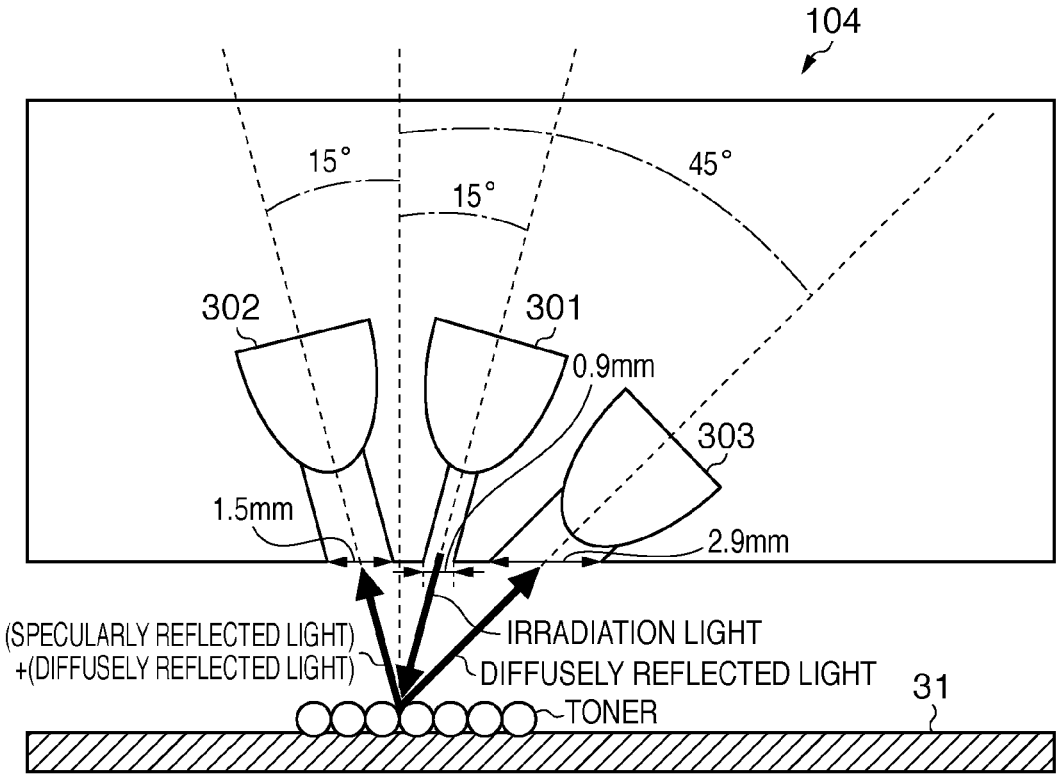
FIG. 3 is a view showing an example of an optical sensor 104.

FIG. 3 is a view showing an example of the optical sensor 104. The optical sensor 104 includes a light emitting element 301 such as an LED, two light receiving elements 302 and 303 such as photodiodes, and a holder. For example, the light emitting element 301 emits infrared light (wavelength: 950 nm) to a patch on the intermediate transfer belt 31 or the background. The light receiving elements 302 and 303 measure the quantity of light reflected by the patch or background. The density calibration control unit 112 of the CPU 101 calculates the amount of toner adhesion based on the reflected light quantity obtained by the optical sensor 104.

Light reflected by the patch or background contains a specularly reflected component and diffusely reflected component. The light receiving element 302 detects both specularly and diffusely reflected components. The light receiving element 303 detects only a diffusely reflected component. When toner adheres to the intermediate transfer belt 31, it cuts off light, decreasing specularly reflected light. That is, an output from the light receiving element 302 decreases.

A black toner absorbs 950 nm infrared light used in the embodiment, and yellow, magenta, and cyan toners diffusely reflect it. Hence, a larger amount of toner adhesion to the intermediate transfer belt 31 increases an output from the light receiving element 303 as for yellow, magenta, and cyan toners. The light receiving element 302 is also influenced by a large amount of toner adhesion. That is, even when yellow, magenta, and cyan toners completely shield the intermediate transfer belt 31 from light, an output from the light receiving element 302 still remains.

The first embodiment sets the irradiation angle of the light emitting element 301 to 15°, the light receiving angle of the light receiving element 302 to 15°, and that of the light receiving element 303 to 45°. These angles define optical axes with respect to the perpendicular of the intermediate transfer belt 31. The aperture diameter of the light receiving element 302 is set smaller than that of the light receiving element 303 in order to minimize the influence of the diffusely reflected component. For example, the aperture diameter of the light emitting element 301 is 0.9 mm, that of the light receiving element 302 is 1.5 mm, and that of the light receiving element 303 is 2.9 mm. The aperture diameter of the light emitting element 301 is set small to place importance on detection accuracy of a positional shift detection mark when the light emitting element 301 is shared between detection of a density calibration control patch image and detection of a positional shift detection mark. When detecting reflected one of light emitted from the light emitting element 301, even a relatively local density variation can be detected at high sensitivity.

A typical example of the optical sensor 104 has been described. However, it will readily occur to those skilled in the art that the optical sensor 104 can be implemented by various well-known types of sensors such as one using infrared light as irradiation light.

[Necessity of Image Density Calibration Control]

In an image forming apparatus 100, the optical sensor 104 serving as an optical detector is arranged to face the intermediate transfer belt 31. Generally in an electrophotographic color image forming apparatus, the electrical characteristics of each unit and printing material, and the attraction force to toner change under various conditions such as exchange of consumables, change of the environment (e.g., change of the temperature or humidity, or degradation of the apparatus), and the number of printed sheets. A change of the characteristics appears as variations of the image density or a change of color reproduction. Such variations obstruct obtaining accurate original color reproduction.

In the first embodiment, to always obtain accurate color reproduction, a plurality of patches (toner images) are formed as test images while changing image forming conditions in a no-image forming state. The optical sensor 104 detects the densities of these patches. The no-image forming state means a state in which a general document or the like created by a user is not formed. Based on the detection result, the density calibration control unit 112 executes image density calibration control. Factors which influence the image density are the charging bias, developing bias, exposure intensity, lookup table, and the like. The first embodiment will exemplify a case wherein image forming conditions are adjusted by correcting a lookup table. A concrete operation of image density calibration control will be described later.

[Necessity of Measuring Information Associated with Actual Circumference]

Figure 4:
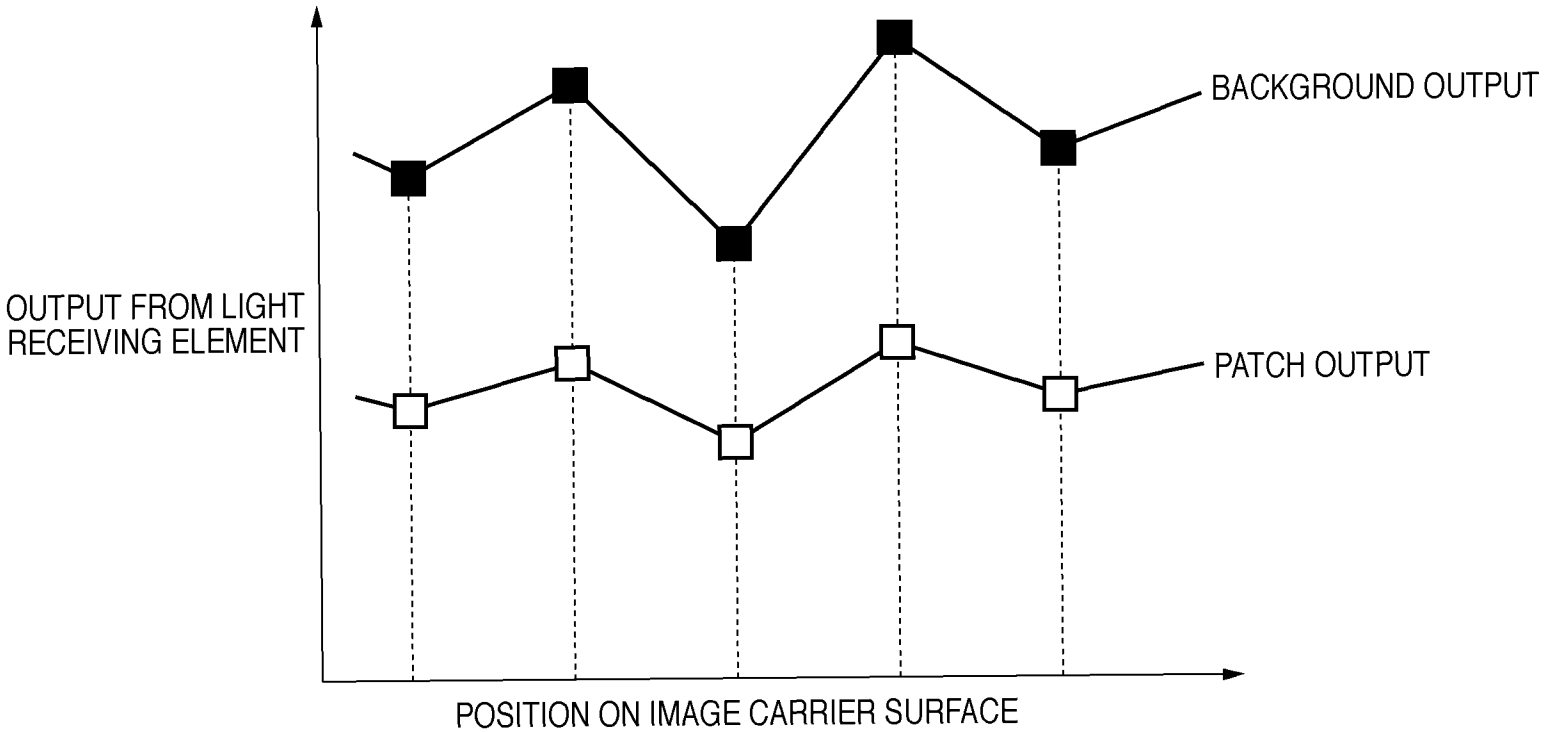
FIG. 4 is a graph exemplifying variations of background outputs and those of patch outputs at a plurality of positions on an intermediate transfer belt.

FIG. 4 is a graph exemplifying variations of background outputs and those of patch outputs at a plurality of positions on the intermediate transfer belt. Patches are toner images formed at the same halftone density. A background output represents a reflected light quantity detected by the light receiving element 302 when no patch is formed on the intermediate transfer belt. A patch output represents a reflected light quantity detected by the light receiving element 302 when a patch is formed on the intermediate transfer belt. As shown in FIG. 4, an output from the light receiving element 302 is influenced by the surface reflectance of the intermediate transfer belt 31 serving as an image carrier (rotation member) in the embodiment. For this reason, patch output values differ from each other though patches are formed at the same density. This also applies to the light receiving element 303.

If image density calibration control is executed under the influence of the reflectance of the background of the intermediate transfer belt 31, density data of a printed halftone image and outputs from the light receiving elements 302 and 303 have less correlation with each other. As a result, the precision of image density calibration control decreases. To cancel the influence of the reflectance of the surface of the intermediate transfer belt 31, it is necessary to measure reflected light beams received by the light receiving elements 302 and 303 in the presence and absence of toner at the same position on the intermediate transfer belt 31. A calculation method of canceling the influence of the reflectance of the surface (background) of the intermediate transfer belt 31 will be described later.

The circumference of the intermediate transfer belt 31 varies in accordance with the manufacturing tolerance, environment, and paper durability (long-term operation of the apparatus). To measure reflected light beams corresponding to the presence and absence of toner at the same position on the intermediate transfer belt 31, the circumference of the intermediate transfer belt 31 needs to be grasped accurately. The time taken for an arbitrary position to rotate one round can be calculated based on a circumference upon expansion/contraction or the expansion and contraction amount, and the process speed as long as a circumference upon expansion/contraction, or the amount by which the intermediate transfer belt expands or contracts can be measured. The calculated time taken for an arbitrary position to rotate one round corresponds to a cycle in which the arbitrary position on the intermediate transfer belt 31 passes through the detection point of the optical sensor 104. From this, when the timer measures the cycle of the intermediate transfer belt 31, the count value of the timer represents an absolute position on the intermediate transfer belt. A detailed mechanism of circumference measurement in the first embodiment will be described later. An arbitrary position in the first embodiment includes even a position where measurement starts when, for example, a plurality of measurement start timings are determined in advance and a measurement start timing closest to input of a measurement start instruction has come. The following description will use an "arbitrary position" and "arbitrary timing", which include the above-described meaning.

[Image Density Calibration Control]

A concrete example of image density calibration control in the first embodiment will be explained with reference to FIGS. 5 and 6. The CPU 101 executes the following processing by loading a control program stored in the ROM 102 into the RAM 103.

Figure 5:
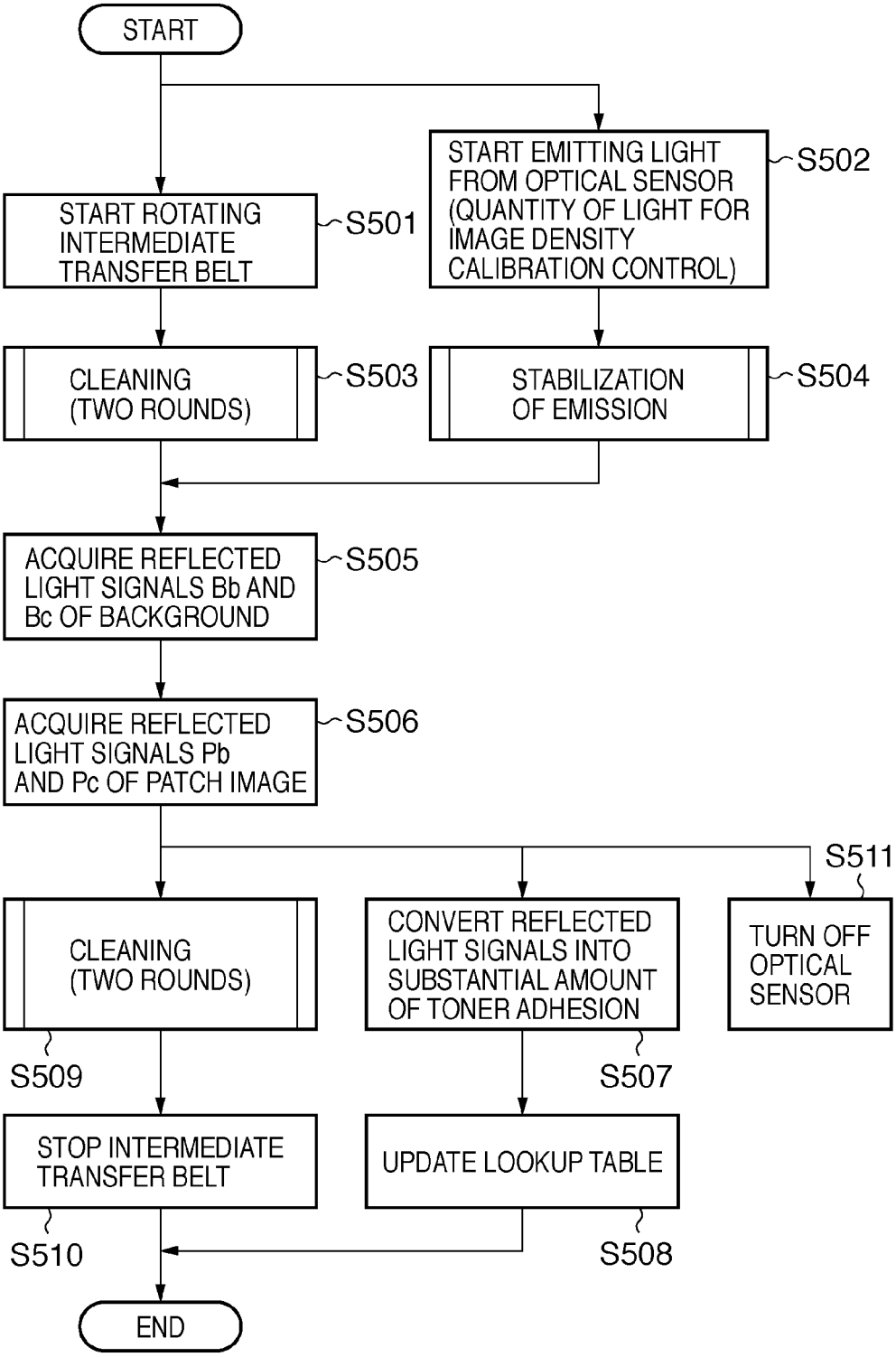
FIG. 5 is a flowchart showing an example of image density calibration control according to the first embodiment.

FIG. 5 is a flowchart showing an example of image density calibration control according to the first embodiment. In step S501, the density calibration control unit 112 starts rotating the intermediate transfer belt 31. In step S502 parallel to step S501, the density calibration control unit 112 causes the optical sensor 104 to emit light at a light quantity setting which is stored in the nonvolatile memory 109 and used to execute image density calibration control.

In step S503, the density calibration control unit 112 instructs the driving control unit 108 to make the intermediate transfer belt 31 rotate two rounds. The driving control unit 108 controls the driving motor of the intermediate transfer belt 31 to make the intermediate transfer belt 31 rotate two rounds. Then, the cleaner 33 removes toner adhered to the intermediate transfer belt 31. In step S504 parallel to step S503, the density calibration control unit 112 monitors output signals from the light receiving elements 302 and 303, and waits until emission of the optical sensor 104 stabilizes. After the density calibration control unit 112 confirms that the emission has stabilized, the process advances to step S505.

In step S505, the density calibration control unit 112 starts acquiring reflected light signals Bb and Bc from the light receiving elements 302 and 303 for light reflected by the intermediate transfer belt 31 itself (i.e., the background). The reflected light signal Bb corresponds to a background output from the light receiving element 302. The reflected light signal Bc corresponds to a background output from the light receiving element 303.

In step S506, the density calibration control unit 112 acquires reflected light signals Pb and Pc corresponding to the respective tones of low to high densities formed on the intermediate transfer belt 31. The reflected light signal Pb corresponds to a patch output from the light receiving element 302. The reflected light signal Pc corresponds to a patch output from the light receiving element 303. More specifically, the density calibration control unit 112 waits until the intermediate transfer belt 31 rotates one round more. After that, the density calibration control unit 112 controls each image forming station to form a patch image (FIG. 6) of each color. The reflected light signals Pb and Pc correspond to light beams reflected by the center of a patch image.

Figure 6:
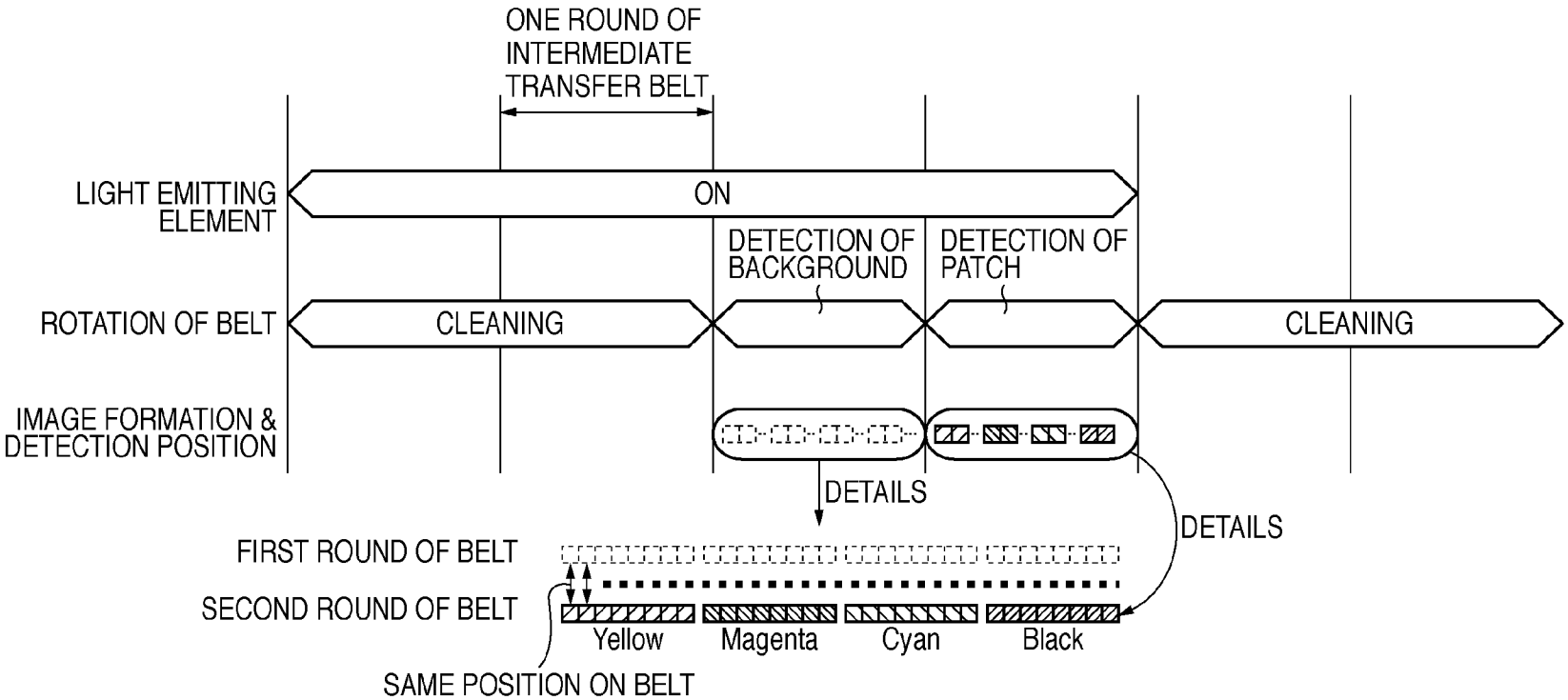
FIG. 6 is a timing chart showing an example of the emission timing, intermediate transfer belt rotation timing, and patch image formation timing.

FIG. 6 is a timing chart showing an example of the emission timing, intermediate transfer belt rotation timing, and patch image formation timing. Cleaning of the intermediate transfer belt is executed during the standby time until stabilization of the light emitting element. Then, a background output is detected, and a patch output is detected. Each image forming station forms patch images in a single color. However, patch images of each color have different densities (different image forming conditions).

In steps S505 and S506, the density calibration control unit 112 controls to acquire a background output and patch output at the same position on the intermediate transfer belt 31. This positional control is achieved by the above-described timing control using the circumference. More specifically, the density calibration control unit 112 acquires a patch output at a timing when a time corresponding to a circumference obtained by the circumference measurement unit 111 has elapsed after a timing when a background output at an arbitrary position was acquired. This can make a background output and patch output acquired at the same position correspond to each other. The timing need not be the time of a timepiece, and suffices to be the count value of a timer. In this manner, the density calibration control unit 112 and circumference measurement unit 111 function to specify a single position on the rotation member using information associated with the circumference of the rotation member.

Upon completion of acquiring all the reflected light signals Pb and Pc from the light receiving elements 302 and 303, the process advances to step S511. The density calibration control unit 112 turns off the light emitting element 301 of the optical sensor 104.

Figure 7:
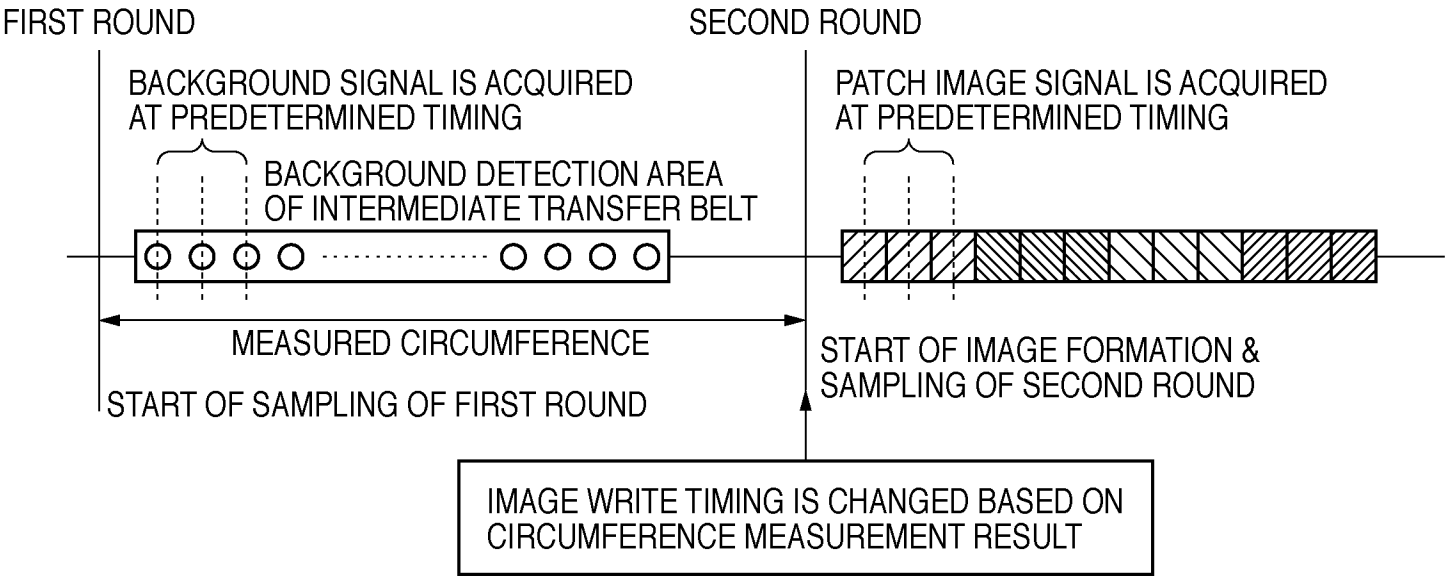
FIG. 7 is a timing chart for explaining sampling of the background density and patch image density.

The above-described steps S505 and S506 will be explained in detail with reference to FIG. 7. FIG. 7 is a timing chart for explaining sampling of the background density and patch image density. Image density calibration control according to the first embodiment adopts the following method to acquire signals representing light beams reflected by the background and a patch image at the same position on the intermediate transfer belt 31.

At the start of background sampling in the first round, the timer starts. By using the value (count value or time) of the activated timer as a reference, the background signal of the intermediate transfer belt 31 is sampled at a predetermined timing stored in advance in the ROM 102.

The time during which the intermediate transfer belt 31 rotates one round is monitored based on information associated with an actual circumference measured in circumference measurement. More specifically, when the time during which the intermediate transfer belt 31 rotates one round has elapsed after the start of background sampling in the first round, patch image formation and patch sampling in the second round start. Whether the time during which the intermediate transfer belt 31 rotates one round has elapsed can be determined by monitoring the value of the timer activated at the start of sampling. Sampling in the second round will be explained in more detail. For example, when a detected circumference measurement result is longer by 1.0 mm than a nominal value (ideal dimension value free from any manufacturing tolerance or environmental variations), a predetermined patch image write timing and sampling start timing are delayed by a time corresponding to 1.0 mm. This control can make the background position and patch position coincide with each other. Similar to sampling in the first round, sampling in the second round also uses the value (count value or time) of the activated timer as a reference. A patch image signal is acquired at a predetermined timing stored in the ROM 102.

As a feature of the present invention, when performing this image density calibration control, information for obtaining the circumference of the intermediate transfer belt 31 that requires an accurate value but may vary is acquired at low cost within a short downtime. This will be explained in detail later.

Referring back to FIG. 5, in step S507 parallel to step S511, the density calibration control unit 112 calculates the substantial amount of toner adhesion based on an acquired patch output serving as the detection result of a patch image corresponding to each tone, and a background output corresponding to the patch image. The substantial amount of toner adhesion is almost the reciprocal of the amount of toner adhered onto the intermediate transfer belt. As the conversion method, a variety of methods are available.

For example, the substantial amount of toner adhesion can be calculated using Bb, Bc, Pb, and Pc:

$$\text{substantial amount of toner adhesion}=(Pb-\alpha*(Pc-Bc))/Bb \quad (1)$$

where $\alpha$ is the constant. The constant $\alpha$ may also be stored in the ROM 102, RAM 103, or nonvolatile memory 109, or calculated from data stored in them. $\alpha$ may change for each model, and is determined by an experiment or simulation.

As described above, a smaller value of the substantial amount of toner adhesion increases the amount of toner adhesion in practice. This is because the quantity of reflected light decreases at high toner density. Bb serving as the denominator of equation (1) means net specularly reflected light (obtained by subtracting a diffusely reflected component) received by the light receiving element 302 upon irradiating a patch image with light. By using a table (FIG. 8) stored in the ROM 102, the substantial amount of toner adhesion can be further converted into an amount of toner adhesion or an actual image density upon actually printing on paper.

Figure 8:
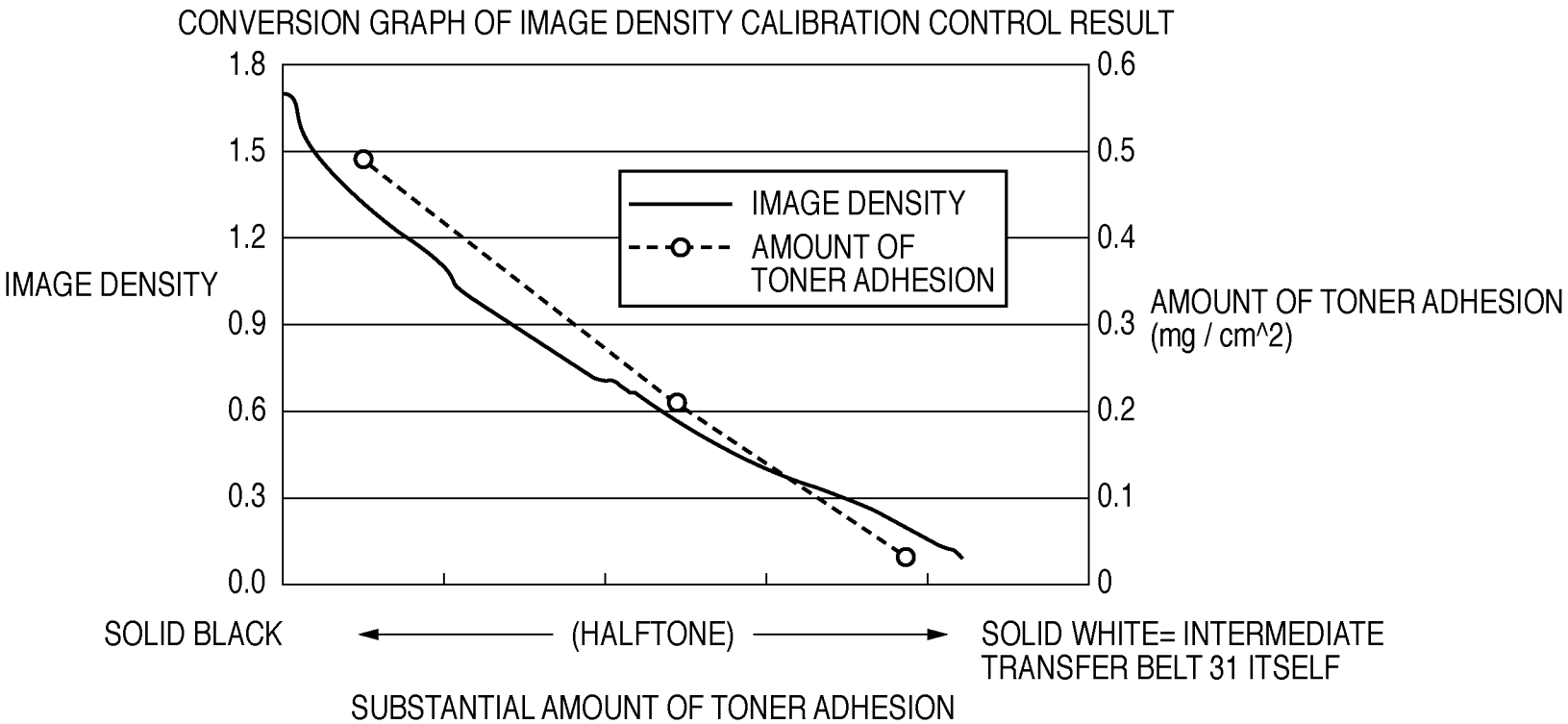
FIG. 8 is a graph showing an example of a table which holds the relationship between the substantial amount of toner adhesion, the image density, and the amount of toner adhesion.

FIG. 8 is a graph showing an example of a table which holds the relationship between the substantial amount of toner adhesion and the image density, and that between the substantial amount of toner adhesion and the amount of toner adhesion. Use of this table allows further conversion of a calculated substantial amount of toner adhesion into an amount of toner adhesion or an image density.

In step S508, the density calibration control unit 112 updates the lookup table so that the result of converting the detection result of each tone of each color into a substantial amount of toner adhesion, amount of toner adhesion, or image density corresponds to an original tone. By updating the lookup table, an image can be formed on a printing material at a set image density.

In this way, the density calibration control unit 112 is an example of a unit which controls the density of a formed image based on each background data and each patch detection result. Each background data is data of light reflected by the background of the rotation member throughout the circumference of the rotation member that starts from an arbitrary position on the rotation member. Each patch detection result is data of light reflected by a patch formed with toner in another round at the same position as the position where each background data has been acquired.

In step S509 parallel to step S507, the density calibration control unit 112 instructs the driving control unit 108 to clean a patch image formed on the intermediate transfer belt 31. This cleaning is done in two rounds of the intermediate transfer belt 31. Upon completion of cleaning, in step S510, the density calibration control unit 112 instructs the driving control unit 108 to stop the rotation of the intermediate transfer belt 31.

[Details of Circumference Measurement Method]

The circumference measurement (calculation) method in the first embodiment will be explained in detail. In the first embodiment, the circumference measurement target is the intermediate transfer belt 31 serving as an example of the rotation member. The circumference of the intermediate transfer belt 31 may be measured using the optical sensor 104 which is also used in image density calibration control. The use of the optical sensor 104 can decrease the number of sensors. In the first embodiment, a plurality of waveform data on the image-formed surface of the intermediate transfer belt 31 are detected to obtain information associated with the actual circumference of the intermediate transfer belt 31 by using detected patterns, which will be described later.

The optical sensor 104 according to the first embodiment employs an LED as a light emitting unit. Light emitted from the LED is incoherent light, unlike a laser or the like which emits coherent light. Coherent light has a uniform wavelength and phase, and allows measuring a speckle pattern obtained upon reflection by an object. For example, coherent light is used to observe the roughness of the object surface. A laser or the like which emits coherent light is generally expensive, and increases the cost of the product. In general, an image sensor is used to measure the speckle pattern. The image sensor is more expensive than a light receiving element such as a photodiode. Hence, an LED lower in cost than a laser or the like is advantageous for measuring the circumference of the intermediate transfer belt 31.

Figure 9:
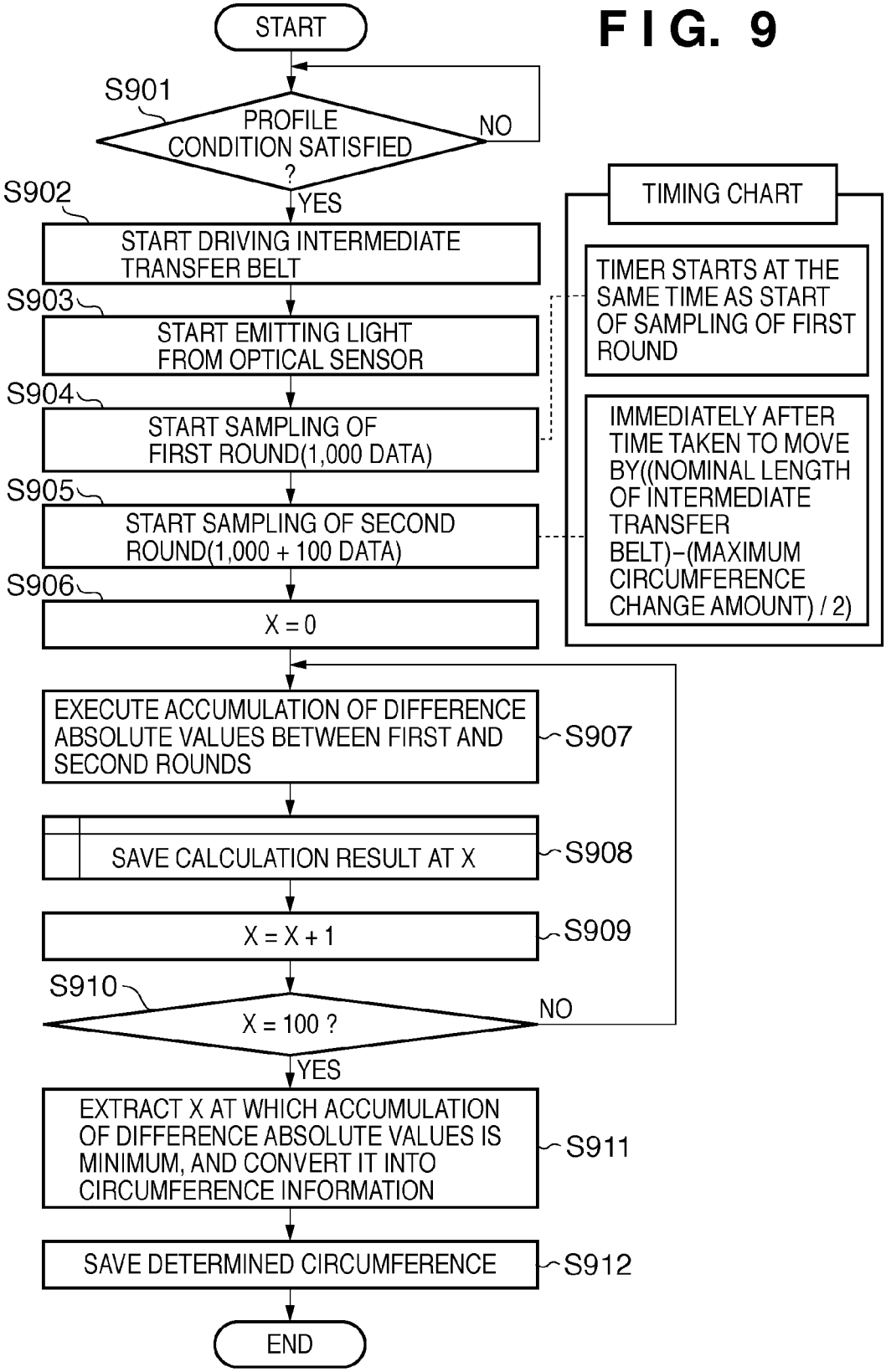
FIG. 9 is a flowchart showing processing to obtain information associated with the actual circumference of the intermediate transfer belt according to the first embodiment.

FIG. 9 is a flowchart showing processing to cause the CPU 101 to acquire two waveform data and obtain information associated with the actual circumference of the intermediate transfer belt based on matching between the two waveform data in the first embodiment. The CPU 101 executes the following processing by loading a control program stored in the ROM 102 into the RAM 103.

In step S901, the circumference measurement unit 111 of the CPU 101 determines whether to measure a circumference. The condition to determine whether to measure a circumference includes the following examples. This determination corresponds to determination of whether to perform image density calibration control.

- a case wherein the number of conveyed sheets after previous circumference measurement is equal to or larger than a predetermined number of sheets.
- a case wherein an environment parameter has varied by a predetermined value or more from the environment in previous circumference measurement.
- a case wherein the standing time after the final print job is equal to or longer than a predetermined time.
- a case wherein a process cartridge has been exchanged.

In step S902, the circumference measurement unit 111 instructs the driving control unit 108 to drive the intermediate transfer belt 31. Then, driving of the intermediate transfer belt 31 starts.

In step S903, the circumference measurement unit 111 causes the light emitting element 301 of the optical sensor 104 to emit the same quantity of light as that in image density calibration control. The background reflects light emitted from the light emitting element 301, and the light receiving element 302 receives the reflected light. The light receiving element 302 outputs a signal corresponding to the reflected light quantity.

In step S904, the circumference measurement unit 111 executes sampling of the first round for the output value of reflected light received by the light receiving element 302. A reflected light output value at each sampling point is stored in the RAM 103 as the waveform profile (first waveform data) of the first round. That is, the circumference measurement unit 111 is an example of an acquisition unit which acquires a pattern as a waveform profile. The circumference measurement unit 111 acquires waveform profiles a plurality of number of times, which will be described later. Acquisitions at respective timings can also be referred to as the first acquisition, second acquisition, and the like. The waveform profile of the first round is an arbitrary profile of reflected light in an arbitrary section on the rotation member because sampling starts at an arbitrary position. The following description will use the term "waveform profile". The waveform profile means the characteristic or feature of measured waveform data.

By this sampling, 1,000 data are acquired in 0.1-mm cycles. The 1,000 data correspond to 100 mm. Considering that the nominal circumference is 800 nm, the length of 100 mm is about ⅛ of the entire length. The measurement start timing in the first round is arbitrary. That is, no intermediate transfer belt need rotate until a specific mark reaches the detection point. This leads to a short downtime. This sampling need not acquire data of one round of the intermediate transfer belt 31. It suffices to acquire data of about ⅛ of the entire length, reducing the memory consumption for storing acquired data.

Figure 10:
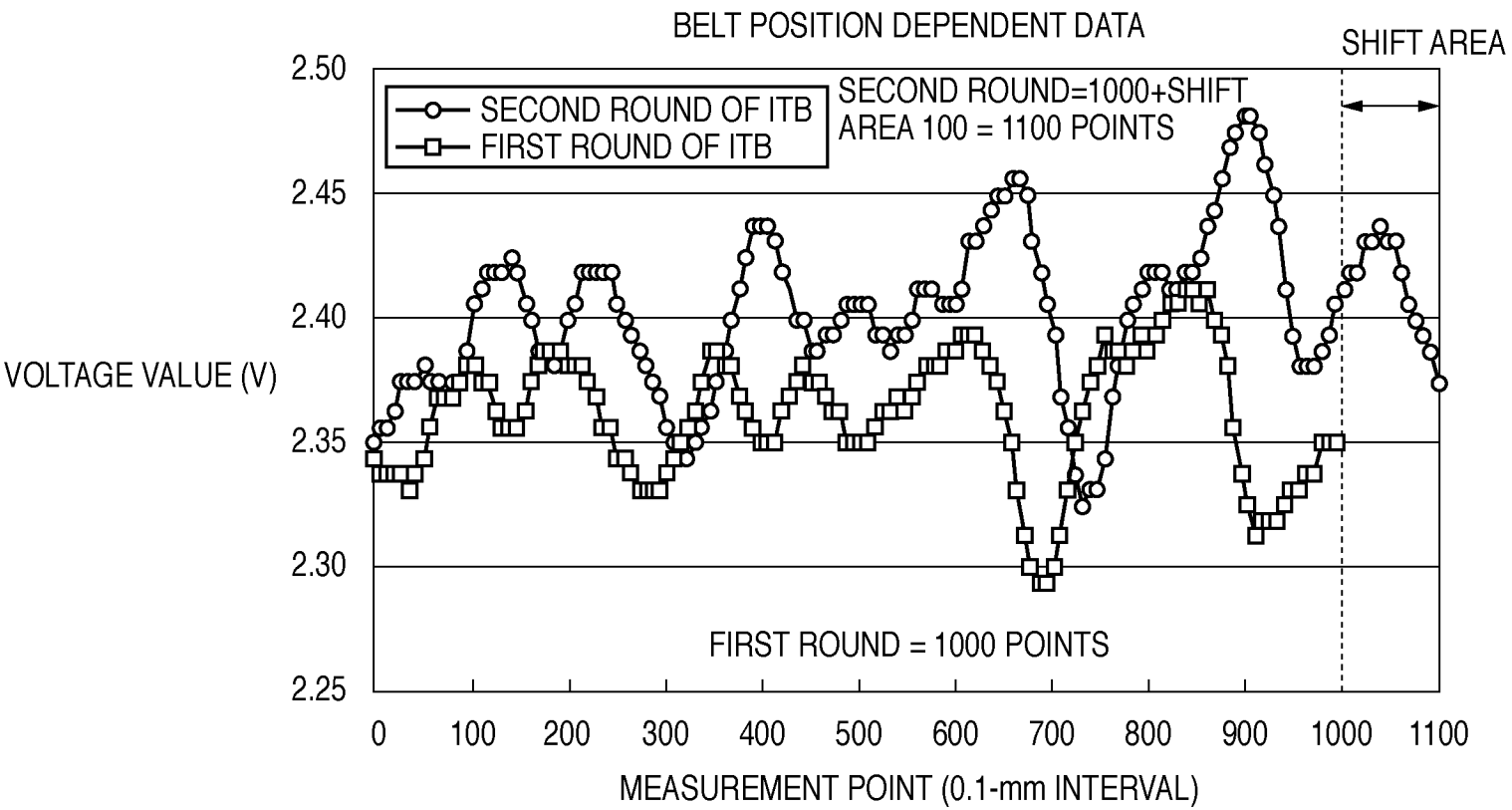
FIG. 10 is a graph showing an example of the relationship between each sampling point and a reflected light output value.

FIG. 10 is a graph showing an example of the relationship between each sampling point and a reflected light output value for two waveform data acquired from the RAM 103. FIG. 10 shows the waveform profiles of the first and second rounds. The waveform profile of the second round contains a larger number of sample values than those in the waveform profile of the first round because a shift area exists. The shift area is a margin for obtaining a shift amount from the nominal circumference. The shift area is determined in consideration of the maximum circumference change amount which is the maximum value of the circumference change amount (expansion and contraction characteristic) of the intermediate transfer belt 31.

Based on the waveform data detection timing of the first round (for example, at the same time as the start of sampling), the circumference measurement unit 111 activates a timer for determining the sampling start timing of the second round. Waveform data of the second round is sampled so that the section of the image-formed surface of one of the waveform data of the first and second rounds falls within the section of the image-formed surface corresponding to the other waveform data. In other words, when the circumference measurement unit 111 acquires two waveform data from the RAM 103, the section of an image-formed surface corresponding to one waveform data falls within that of an image-formed surface corresponding to the other waveform data. From this, waveform data of the second round is sampled at a timing which is adjusted by a predetermined time from a predetermined reference time necessary for the intermediate transfer belt 31 to rotate only one round by using the waveform data detection timing of the first round as a reference. The RAM 103 stores the sampled waveform data. In the case of FIG. 9, a value obtained by subtracting half the maximum circumference change amount from one nominal circumference is set in the timer. The value subtracted from one nominal circumference when setting the timer is not limited to half the maximum circumference change amount. A predetermined value may also be set as long as no measurement error frequently occurs. When the timing set in the timer has come, the process advances to step S905.

As shown in FIG. 10, waveform data acquired from the RAM 103 corresponds to the section of part of the intermediate transfer belt 31 serving as a rotation member. The amount of data stored in the RAM 103 in sampling can be reduced, suppressing memory utilization.

In step S905, the circumference measurement unit 111 executes sampling of the second round for the output value of reflected light received by the light receiving element 302. The number of sampling points in the second round is larger than that of sampling points in the first round, and corresponds to a long detection time. Considering a shift amount from the nominal circumference, one waveform data corresponds to a longer sampling time (detection time) than the other waveform data.

Figure 11:
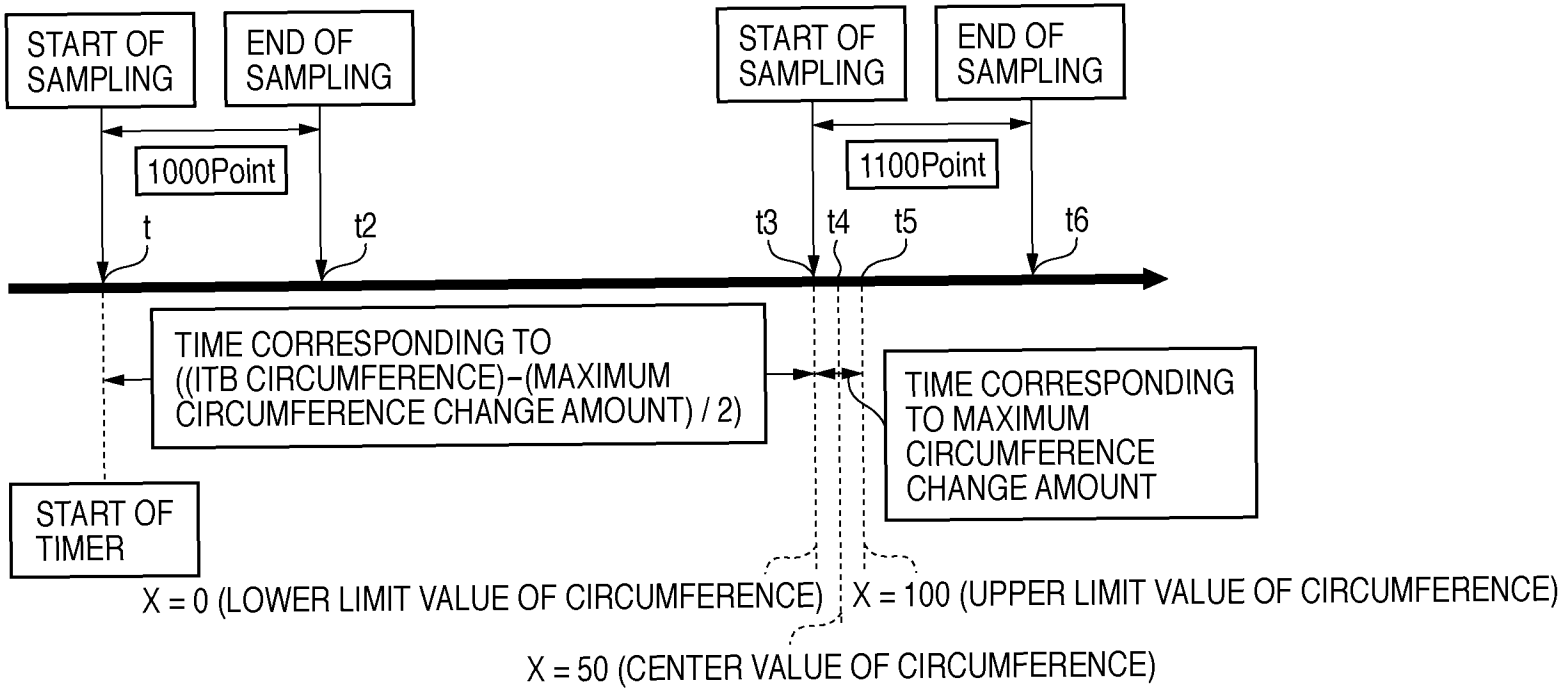
FIG. 11 is a timing chart for explaining timings from the sampling start timing t1 of the first round to the sampling end timing t6 of the second round.

FIG. 11 is a timing chart for explaining timings from the sampling start timing t1 of the first round to the sampling end timing t6 of the second round. t1 represents the sampling start timing (first timing) of the first round. t2 represents the sampling end timing of the first round, and t3 represents the sampling start timing (second timing) of the second round. t4 represents a timing corresponding to the nominal circumference from t1 serving as the start point. t5 represents a timing when the expansion amount of the circumference maximizes.

The interval between t1 and t2 represents the sampling period (first period) of the first round. The interval between t3 and t6 represents the sampling period (second period) of the second round.

The interval between t1 and t3 corresponds to the shortest time necessary for the intermediate transfer belt to rotate when the circumference of the intermediate transfer belt 31 varies to be the shortest. That is, the interval between t1 and t3 is the time calculated by dividing, by the process speed, a length obtained by subtracting half the maximum circumference change amount from the nominal circumference of the intermediate transfer belt. This aims at making the sampling start point of the first round fall within the section where the waveform profile of the second round has been acquired. If sampling is executed slightly excessively, the interval between t1 and t3 may also be further shortened.

The interval between t1 and t4 is the time obtained by dividing the nominal circumference of the intermediate transfer belt 31 by the process speed. The interval between t1 and t4 is a reference time necessary for the intermediate transfer belt 31 having the nominal circumference to rotate one round.

The sampling interval of the second round is 0.1 mm, similar to the first round. However, the number of sampling points in the second round is larger than that of sampling points in the first round. When the number of sampling points in the first round is 1,000 and the shift amount is 100 points, the number of sampling points in the second round is 1,100. In this example, the maximum circumference change amount is 10 mm. The RAM 103 also stores the waveform profile (second waveform data) of the second round. FIG. 10 shows the relationship between each sampling point and a reflected light output value.

In the flowchart of FIG. 9, all sampled data are handled as waveform data, but the data are not limited to them. It suffices to acquire data for pattern matching calculation (to be described later). For example, extra sampling may also be done at the start and/or end timing to acquire two waveform data necessary for pattern matching calculation from the memory. As a example, a case wherein only data necessary for pattern matching calculation are sampled will be exemplified.

After the end of sampling in the first and second rounds, a variable X representing the shift amount is initialized to 0 in step S906. As will be described later, the circumference measurement unit 111 compares the waveform profile of the first round, and a plurality of waveform profiles (third waveform data) which are shifted by different shift amounts in the waveform profile of the second round and are equal in length to the waveform profile of the first round. The third waveform data are reflected light comparison profiles in a plurality of sections that are shifted by different shift amounts from a reference position based on one nominal circumference starting from the start position of a section where the waveform profile of the first round has been acquired.

In step S907, the circumference measurement unit 111 accumulates difference absolute values between the waveform profile of the first round and that (third waveform data) of the second round, in order to perform pattern matching between the two waveform data. For example, the accumulation is executed by $$I(X) = \sum_{i=1}^{1000} |V_{first\ round}(i) - V_{second\ round}(i + X)| \quad (2)$$

where I(X) is an accumulated value for the shift amount X, $V_{first\ round}(i)$ is a reflected light output value at the point i in the first round, and $V_{second\ round}(i+X)$ is a reflected light output value at the point i+X in the second round. Note that X=0, 1, 2, . . . , 100.

In step S908, the circumference measurement unit 111 stores the accumulated value I(X) in the RAM 103. In step S909, the circumference measurement unit 111 increments the X value by one. In step S910, the circumference measurement unit 111 determines whether the X value has exceeded the maximum shift amount. If no X value has exceeded the maximum shift amount, the process returns to step S907. If the X value has exceeded the maximum shift amount, the process advances to step S911. In this fashion, the circumference measurement unit 111 calculates accumulated values I(X) for all X from X=0 to X=100.

In step S911, the circumference measurement unit 111 determines the minimum value among the calculated accumulated values I(X). When $V_{first\ round}(i)$ as one of two waveform data is used as reference waveform data, waveform data which matches $V_{first\ round}(i)$ can be extracted by the processing of determining the minimum accumulated value. Similarly in step S911, X corresponding to the minimum accumulated value I is extracted. The specified X represents a shift (expansion or contraction) from a predetermined nominal circumference serving as a reference. Thus, X is information (interval information) corresponding to the interval between $V_{first\ round}(i)$ serving as reference waveform data, and waveform data corresponding to X which gives a minimum accumulated value I. The X value becomes larger as the interval between reference waveform data and waveform data corresponding to X which gives a minimum accumulated value I becomes larger, and vice versa.

Figure 12:
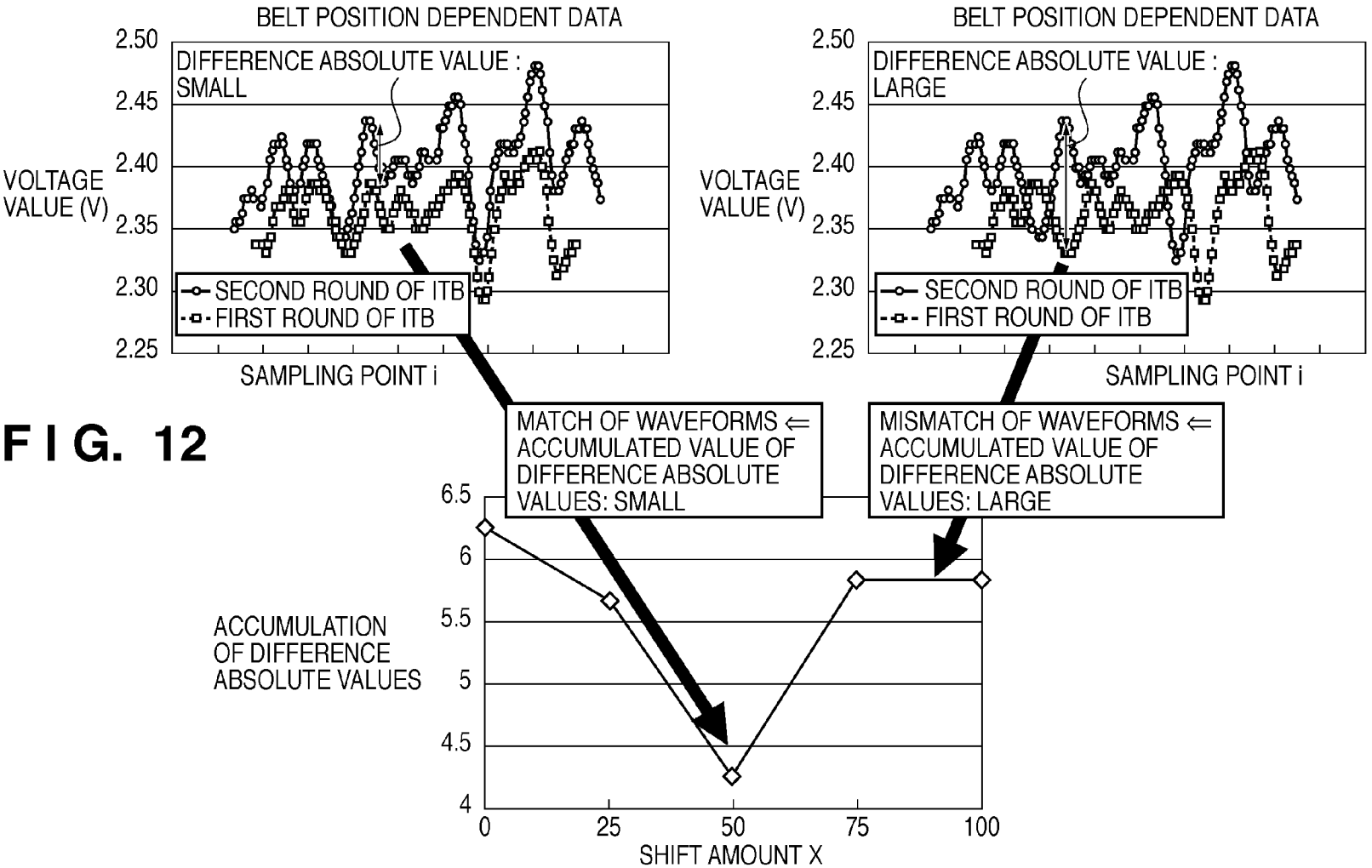
FIG. 12 is a graph showing the relationship between the waveform profiles of the first and second rounds and accumulated values according to the first embodiment.

FIG. 12 is a graph showing the relationship between the waveform profiles of the first and second rounds and accumulated values according to the first embodiment. FIG. 12 shows that the accumulated value minimizes when the correlation between two waveform profiles maximizes. This is based on the fact that reflected light output values detected at the same position are almost equal to each other. In contrast, reflected light output values detected at different positions have a low correlation and different waveform profiles. Thus, the accumulated value becomes relatively large. From this, the circumference measurement unit 111 has a function of extracting a comparison profile closest to an arbitrary profile from a plurality of comparison profiles. In this manner, a portion where the correlation between the waveforms of the first and second rounds is high is specified by equation (2), calculating information associated with the circumference of the intermediate transfer belt 31. This is a feature of the present invention.

In step S912, the circumference measurement unit 111 calculates an actual circumference which is information for grasping the circumference of the intermediate transfer belt and information (interval information) corresponding to the interval between waveform data. The circumference measurement unit 111 stores the calculated actual circumference in the RAM 103 or nonvolatile memory 109. The RAM 103 or nonvolatile memory 109 is an example of a storage unit which stores information representing a measured actual circumference. For example, the actual circumference can be calculated by equation (3) using an X value which gives a minimum accumulated value. Equation (3) calculates the actual circumference of the rotation member from the nominal circumference and a shift amount obtained by comparing extracted waveform data and reference waveform data:

$$\text{actual circumference} = (X_{profile\ result} - X_{ITB\ ideal}) * 0.1 + \text{nominal circumference} \quad (3)$$

where $X_{profile\ result}$ is X which gives a minimum the accumulated value obtained in step S911, $X_{ITB\ ideal}$ is X (in this case, X=50) when the ITB circumference has a nominal value, and the nominal circumference is an ideal dimension value (792.1 mm for the intermediate transfer belt 31 of the first embodiment) when the ITB circumference is free from any manufacturing tolerance or environmental variations. The term "$(X_{profile\ result} - X_{ITB\ ideal})*0.1$" in equation (3) represents a shift (unit: mm) from an ideal dimension value when the measured circumference of the intermediate transfer belt 31 is free from any manufacturing tolerance or environmental variations. "*0.1" corresponds to sampling at an interval of 0.1 mm. When sampling is executed at an interval of 0.2 mm, it suffices to multiply 0.2.

When storing obtained information for grasping an actual circumference, the information may also be converted into time or length. In short, as described with reference to FIG. 7, information can be used to monitor the lapse of time during which the intermediate transfer belt 31 rotates one round accurately. The circumference measurement unit 111 also functions as a unit which calculates the actual circumference of a rotation member from a shift amount corresponding to an extracted comparison profile and the nominal circumference.

The density calibration control unit 112 of the CPU 101 executes the above-described image density calibration control using the value calculated by equation (3) serving as information associated with the actual circumference of the intermediate transfer belt 31 that has been determined in step S912. As the information associated with the actual circumference, an expansion and contraction amount may also be obtained from a value calculated by subtracting 50 from X which gives a minimum accumulated value, and the time during which an arbitrary position rotates one round may also be calculated based on the obtained expansion and contraction amount. More specifically, the time (negative value for a negative expansion and contraction amount) corresponding to the obtained expansion and contraction amount is added to the time taken for the intermediate transfer belt 31 having the nominal circumference to rotate one round. As a result, image density calibration control can be executed accurately.

After executing image density calibration control, the CPU 101 returns to step S101 again. If the circumference measurement condition is satisfied, the CPU 101 executes the flowchart shown in FIG. 9.

Figure 13:
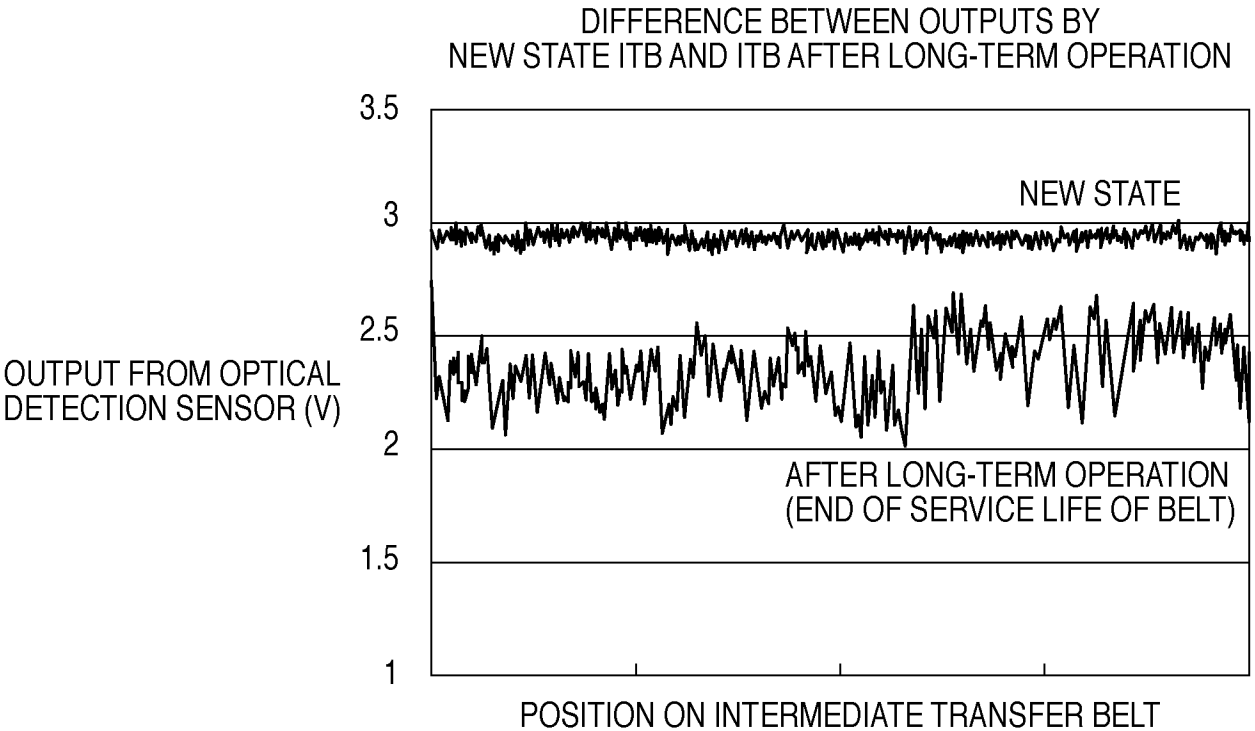
FIG. 13 is a graph showing the position dependence of an intermediate transfer belt 31 when a light receiving element 302 receives light reflected by the background of the intermediate transfer belt 31.

FIG. 13 is a graph showing the position dependence of the intermediate transfer belt 31 when the light receiving element 302 receives light reflected by the background of the intermediate transfer belt 31. As shown in FIG. 13, when the intermediate transfer belt 31 is a new state one, background reflected light is almost uniform regardless of the position on the intermediate transfer belt 31. When the intermediate transfer belt 31 comes close to the end of its service life after conveying many papers (many printed papers), background reflected light becomes non-uniform depending on the position on the intermediate transfer belt 31.

According to the circumference measurement method of the first embodiment, the circumference of the intermediate transfer belt 31 is obtained by detecting a portion where the waveform profiles of the first and second rounds coincide with each other. As nonuniformity of background reflected light depending on the position on the intermediate transfer belt 31 is larger, the reliability of the detection result becomes higher. Even if the intermediate transfer belt 31 changes over time, the circumference can be obtained.

Figure 14:
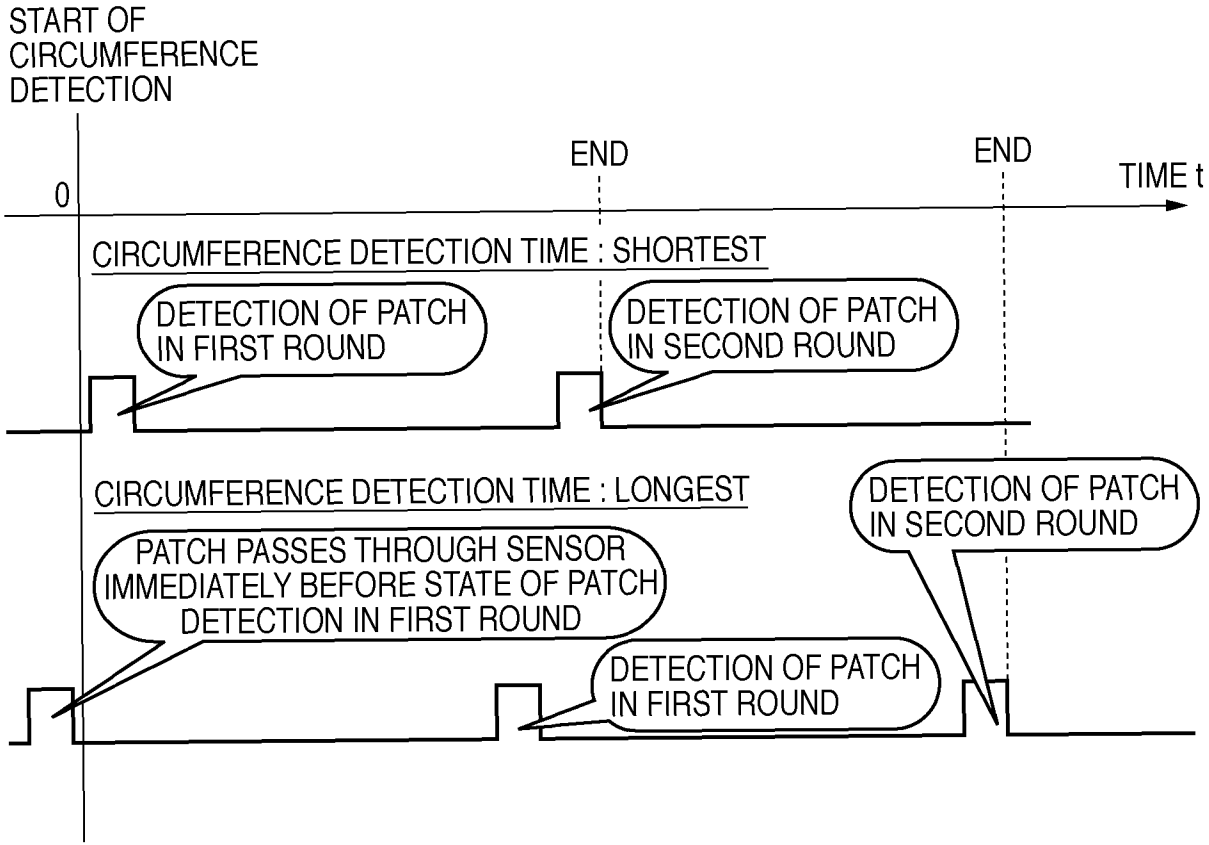
FIG. 14 is a timing chart showing the timing when a patch is detected by a circumference measurement method serving as a comparative example.

The result of detecting the circumference of the intermediate transfer belt 31 by using the circumference measurement method according to the first embodiment will be explained with reference to FIG. 14 and Table 1 in comparison with a result by a circumference measurement method serving as a comparative example. FIG. 14 is a timing chart showing the timing when a patch is detected by the circumference measurement method serving as a comparative example. Table 1 represents the circumference detection precision and the maximum time taken for the circumference detection when the circumference of the intermediate transfer belt 31 was detected 50 times by the circumference measurement method according to the first embodiment, and the detection precision and the maximum time taken for the circumference detection by the circumference measurement method serving as a comparative example. According to the circumference measurement method serving as a comparative example, a mark is attached to the surface of the intermediate transfer belt, and the optical sensor receives light reflected by the mark, thereby measuring the circumference of the intermediate transfer belt.

As shown in FIG. 14, according to the circumference measurement method serving as a comparative example, the maximum time taken for circumference detection is the time taken for the intermediate transfer belt 31 to rotate two rounds at maximum. The maximum time is as long as 8.8 sec, as represented in Table 1. In contrast, the circumference measurement method of the first embodiment can start circumference measurement at an arbitrary timing, and can shorten the time by about 4 sec from that of the comparative example. That is, the circumference measurement method of the first embodiment can shorten the processing time taken to measure the circumference of the intermediate transfer belt 31. The circumference detection precision by the circumference measurement method of the first embodiment is as high as 0.4 mm, similar to the comparative example.

TABLE 1

| | Detection Precision (Max-Min) | Maximum Time Taken For Circumference Detection (sec) |
|---|---|---|
| Comparative Example (Circumference Detection Mark + Circumference Detection Sensor) | 0.4 mm | 8.8 sec |
| Circumference Measurement Method of Present Invention (Detection Sensor Also Serves As Density Detection Sensor) | 0.4 mm | 4.9 sec |

Figure 15:
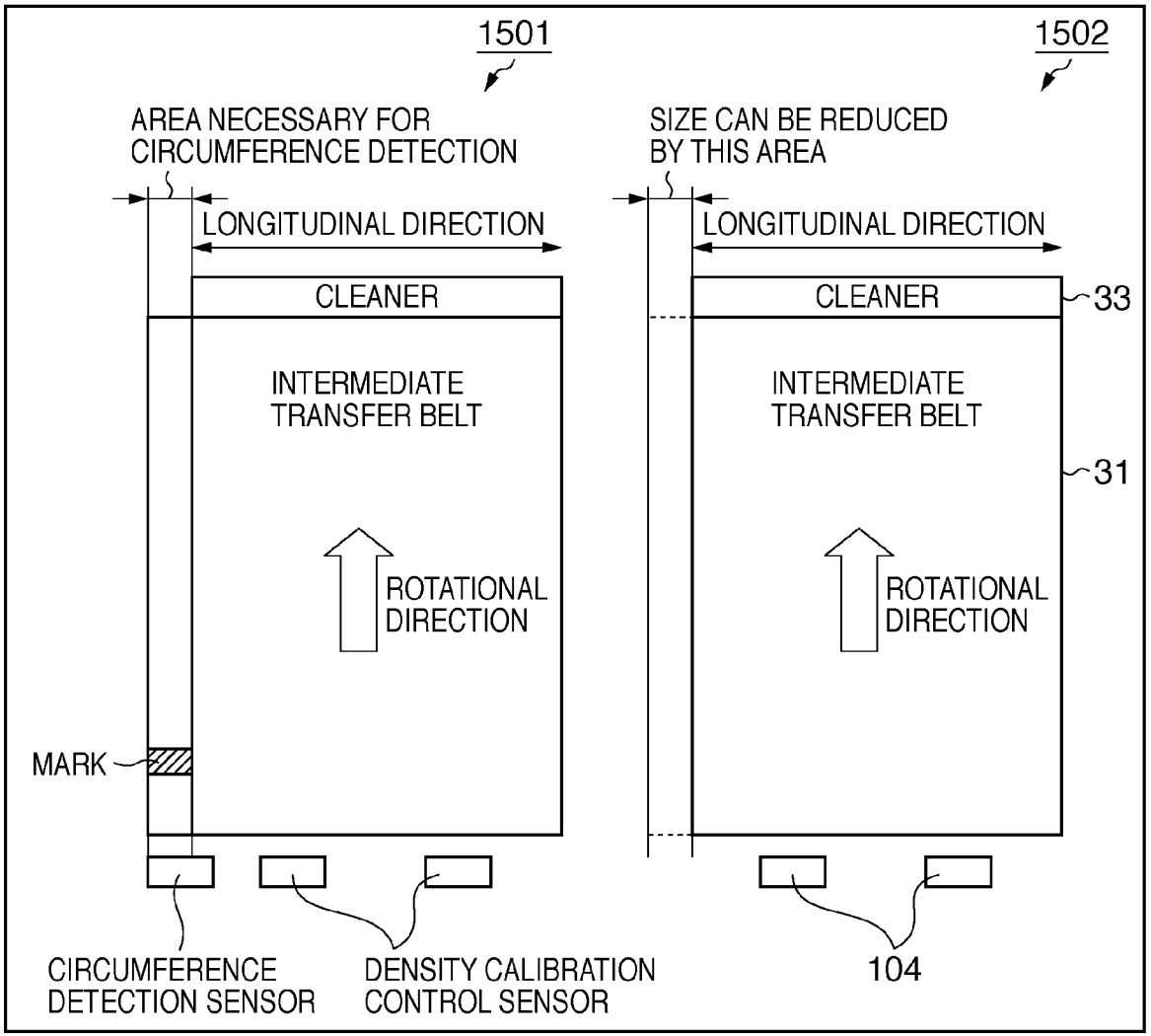
FIG. 15 is a view showing the operation of a cleaner.

The reason why the circumference measurement method according to the first embodiment is effective for downsizing the apparatus will be explained with reference to FIG. 15. FIG. 15 is a view showing the operation of the cleaner. An arrangement 1501 is necessary for circumference measurement by the comparative example. An arrangement 1502 is necessary for circumference measurement by the first embodiment.

In the comparative example, when the mark exists within a longitudinal range in the cleaning area of the cleaner in the arrangement 1501, the cleaner passes over the mark, degrading the cleaning performance of the cleaner. To prevent this, the mark must be arranged at a position where it does not overlap the longitudinal range in the cleaning area of the cleaner 33, as represented by the arrangement 1501. The circumference detection mark needs to be arranged at an end in the longitudinal direction. As a result, the comparative example cannot downsize the image forming apparatus. The circumference detection mark is generally set to a size of 8 to 10 mm in order to detect it by a circumference detection sensor even when the belt skews by a maximum amount. To the contrary, the circumference measurement method according to the first embodiment requires neither the circumference detection sensor nor mark, as represented by the arrangement 1502, and is advantageous for downsizing the apparatus.

As described above, the image forming apparatus according to the first embodiment detects waveform data of the image-formed surface of a rotation member at an arbitrary timing. The image forming apparatus detects the waveform data of the second round at a timing upon the lapse of a predetermined time from the arbitrary timing in the second round. The image forming apparatus obtains information associated with the actual circumference of the rotation member using the respective detected waveform data. The image forming apparatus need adopt neither a mark nor an optical sensor for detecting the mark, unlike the circumference measurement method described as the comparative example in which a mark is formed at the end of the rotation member to measure the actual circumference of the rotation member using an optical sensor for detecting the mark. To maintain the detection precision, the mark is formed at the end of the rotation member that is not an image-formed surface. The mark formed at the end makes the rotation member wider. Further, the optical sensor for detecting the mark needs to be arranged at a position where it can detect the mark. This increases the apparatus size and cost. Unlike the comparative example, the image forming apparatus according to the first embodiment obtains information associated with the actual circumference of the rotation member by detecting waveform data of the image-formed surface of the rotation member. Thus, the image forming apparatus is advantageous for reducing the apparatus size and cost.

In the comparative example, the rotation member needs to be driven to rotate two rounds at maximum depending on the first mark position because the mark is detected twice in order to measure the circumference. However, the image forming apparatus according to the first embodiment starts detecting waveform data of the first round at an arbitrary timing. In the image forming apparatus, the time taken to detect waveform data is a period obtained by adding the time taken for the rotation member to rotate one round and the time taken to detect waveform data of the second round. The image forming apparatus can shorten the time taken for circumference measurement, compared with the comparative example.

The image forming apparatus need not form a patch image or the like for measuring the circumference of the rotation member, and is advantageous in processing load and toner consumption. Further, in the image forming apparatus, the optical sensor emits light to the image-formed surface of the rotation member in order to acquire a waveform profile. As the optical sensor, a density calibration control optical sensor or color misalignment calibration control optical sensor is available, reducing the cost. The image forming apparatus can detect a relative position on the rotation member and the expansion and contraction characteristic of the rotation member by using waveform data of the image-formed surface of the rotation member. The image forming apparatus can execute higher-precision circumference measurement even for a rotation member after long-term operation.

The image forming apparatus performs pattern matching between two acquired waveform data. Even if the intermediate transfer belt 31 deteriorates, two waveform data corresponding to the deteriorated belt surface are compared, accurately obtaining information associated with the circumference. That is, the image forming apparatus is resistant to deterioration over time. The image forming apparatus can obtain information associated with the actual circumference of the rotation member by acquiring the waveform profile of only a partial section. The efficiency of utilization of a memory which holds the acquired waveform profile can increase.

The image forming apparatus according to the first embodiment can shorten the time taken for circumference detection of the rotation member, measure the circumference at high precision, and execute more accurate density calibration control. In addition, the image forming apparatus according to the first embodiment can prevent an increase in cost when assembling the mechanism for obtaining information associated with the actual circumference of the rotation member.

[Examples of Failure in Circumference Measurement]

The above-described method of measuring information on the circumference according to the embodiment sometimes results in a so-called measurement failure in obtaining a desired measurement precision owing to various causes. Two characteristic examples of the measurement failure will be described. Examples of the measurement failure are not limited to these two. Measurement failures may arise from similar or different causes.

(Measurement Failure Example 1)

In circumference measurement failure example 1 in the profile circumference detection method, the failure determination criterion adopts the following method. One main factor causing a profile circumference detection failure is a plurality of foreign substances adhered to the driving roller 8 facing the optical sensor 104.

Figure 16:
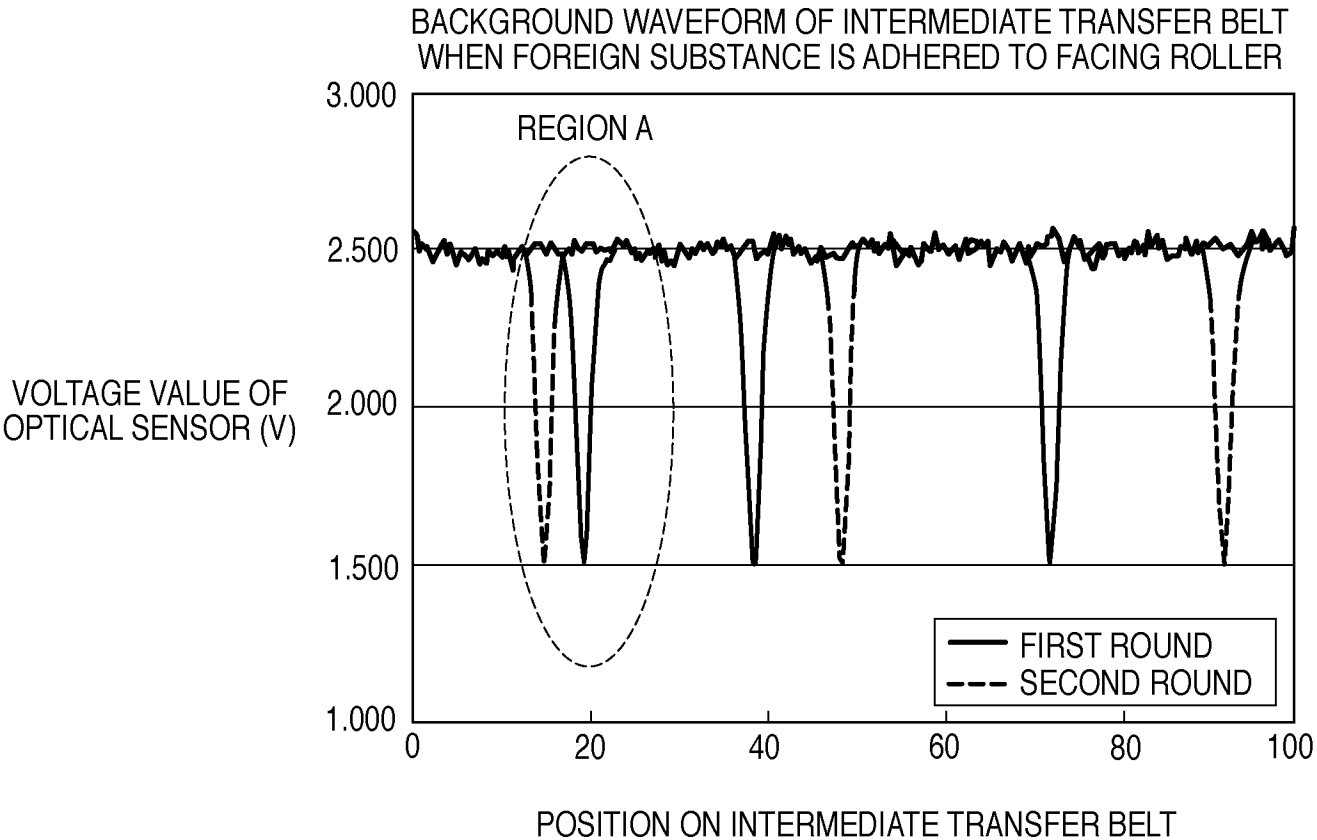
FIG. 16 is a graph showing an example of the output waveform of an optical sensor in circumference measurement failure example 1 according to the embodiment.

FIG. 16 shows the background waveform of the intermediate transfer belt 31 when three foreign substances are adhered to the driving roller 8. In the image forming apparatus of the embodiment, the circumference of the driving roller 8 facing the optical sensor 104 is not an integer multiple of the circumference of the intermediate transfer belt 31. In this case, peaks corresponding to foreign substance patterns may overlap as represented in region A in FIG. 16. As shown in FIG. 16, a drop of the voltage value of the optical sensor 104 due to foreign substances on the driving roller 8 occurs upon abrupt changes of the reflectance and reflection direction of the intermediate transfer belt 31 that are caused by the foreign substances.

Figure 17:
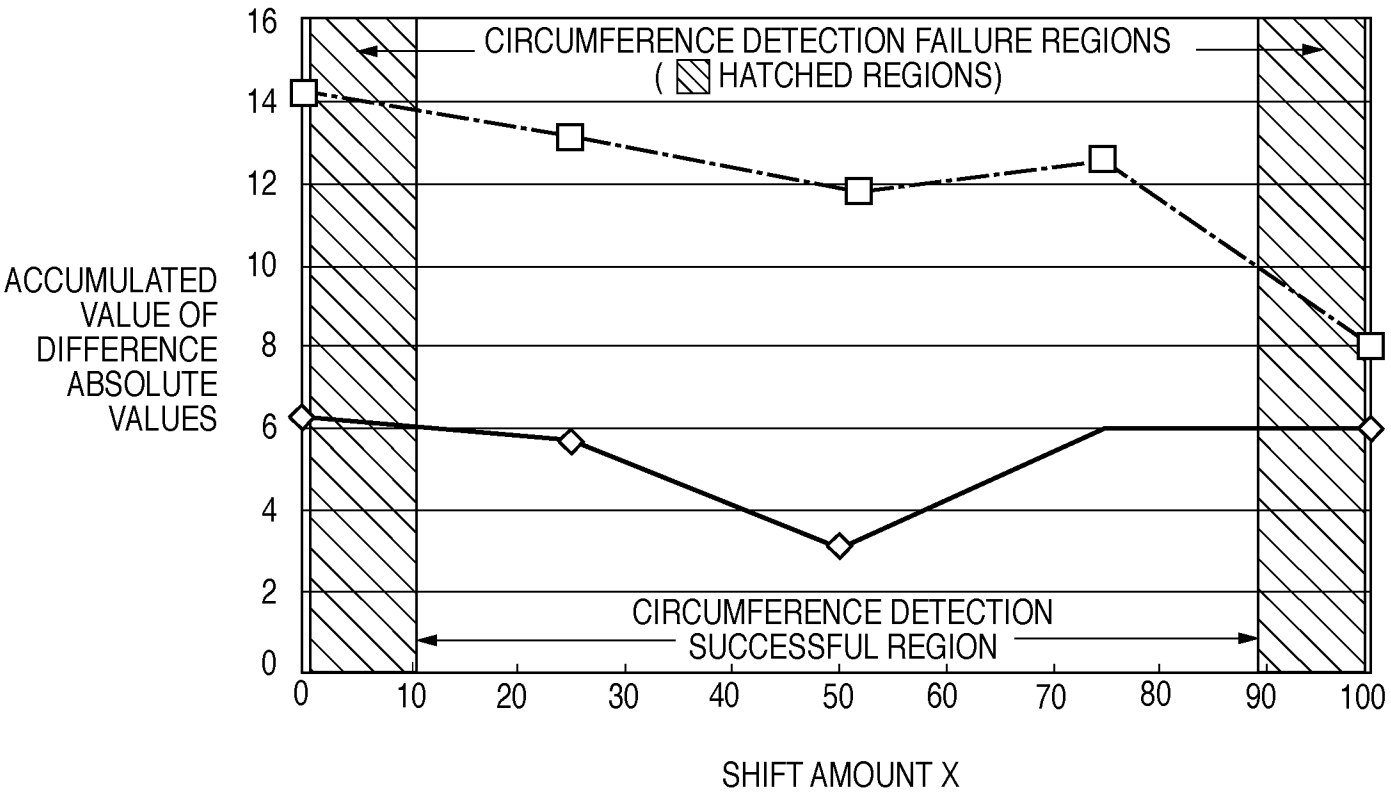
FIG. 17 is a graph showing the relationship between the accumulated value of calculated difference absolute values and the shift amount X in circumference measurement failure example 1 according to the embodiment.

In this situation, as shown in FIG. 17, point X, which gives a minimum accumulated value of the difference absolute values of profiles as a result of sampling of the first and second rounds, shifts to a direction in which point X coincides with not the peak of the background profile of the intermediate transfer belt 31, but that of the foreign substance pattern of the driving roller 8. When point X coincides with the peak of the foreign substance pattern, the X value which gives a minimum accumulated value tends to be excessively large or small (broken line in FIG. 17).

From this, regions at the shift amount X=0 to 10 and 90 to 100 are set as error determination regions in determination in failure example 1 of the circumference detection method according to the embodiment. When the accumulated value of difference absolute values calculated by equation (2) falls within the ranges of the shift amount X=0 to 10 and 90 to 100, it is determined that the profile circumference detection has failed. This corresponds to a case wherein the first waveform data and second waveform data respectively acquired in steps S904 and S905 of FIG. 9 match each other in a range where reliability is low.

(Circumference Measurement Failure Example 2)

Figure 18:
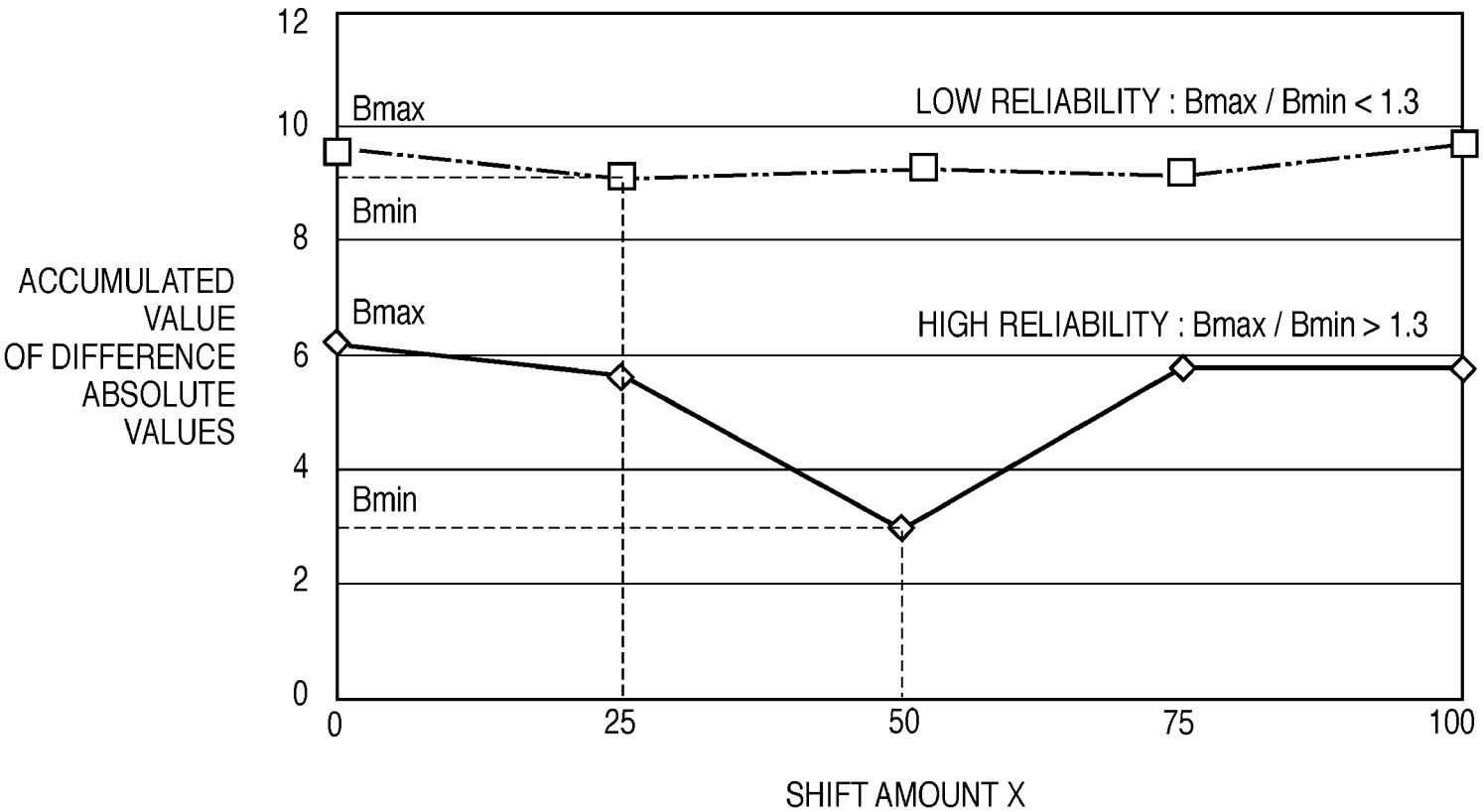
FIG. 18 is a graph showing the relationship between the accumulated value of calculated difference absolute values and the shift amount X in circumference measurement failure example 2 according to the embodiment.

Even in a situation in which no foreign substance is adhered to the driving roller 8, profile circumference detection may fail. For example, a point which gives a definitely minimum accumulated value may not exist, as represented by a chain line in FIG. 18. Thus, a circumference for which waveforms match each other cannot be specified.

In this case, a given trend appears in the accumulated value I(X) of differences between two waveform data that is used as an evaluation value for determining whether the two waveform data match each other when the shift amount X changes from 0 to 100. More specifically, the ratio Bmax/Bmin between the maximum accumulated value Bmax of differences and the minimum accumulated value Bmin of differences tends to be low. In the profile circumference detection method of the embodiment, it may be determined based on inequality (4) whether to use circumference information obtained by executing the flowchart of FIG. 9:

$$B\max/B\min > 1.3 \quad (4)$$

If Bmax/Bmin becomes lower than 1.3, it is determined that a point which gives a definitely minimum accumulated value does not exist. It is, therefore, determined that the profile circumference detection has highly likely failed. When the reliability of profile circumference detection is high, as represented by a solid line in FIG. 18, Bmax/Bmin is equal to or higher than 1.3 in inequality (4).

Inequality (4) employs the ratio between the maximum accumulated value Bmax of differences and the minimum accumulated value Bmin of differences. The difference between the maximum accumulated value Bmax of differences and the minimum accumulated value Bmin of differences also exhibits the same trend as that of the ratio. A circumference measurement failure can be determined using an appropriate threshold.

[Details of Circumference Measurement Method Upon Circumference Measurement Failure According to First Embodiment]

Figure 19:
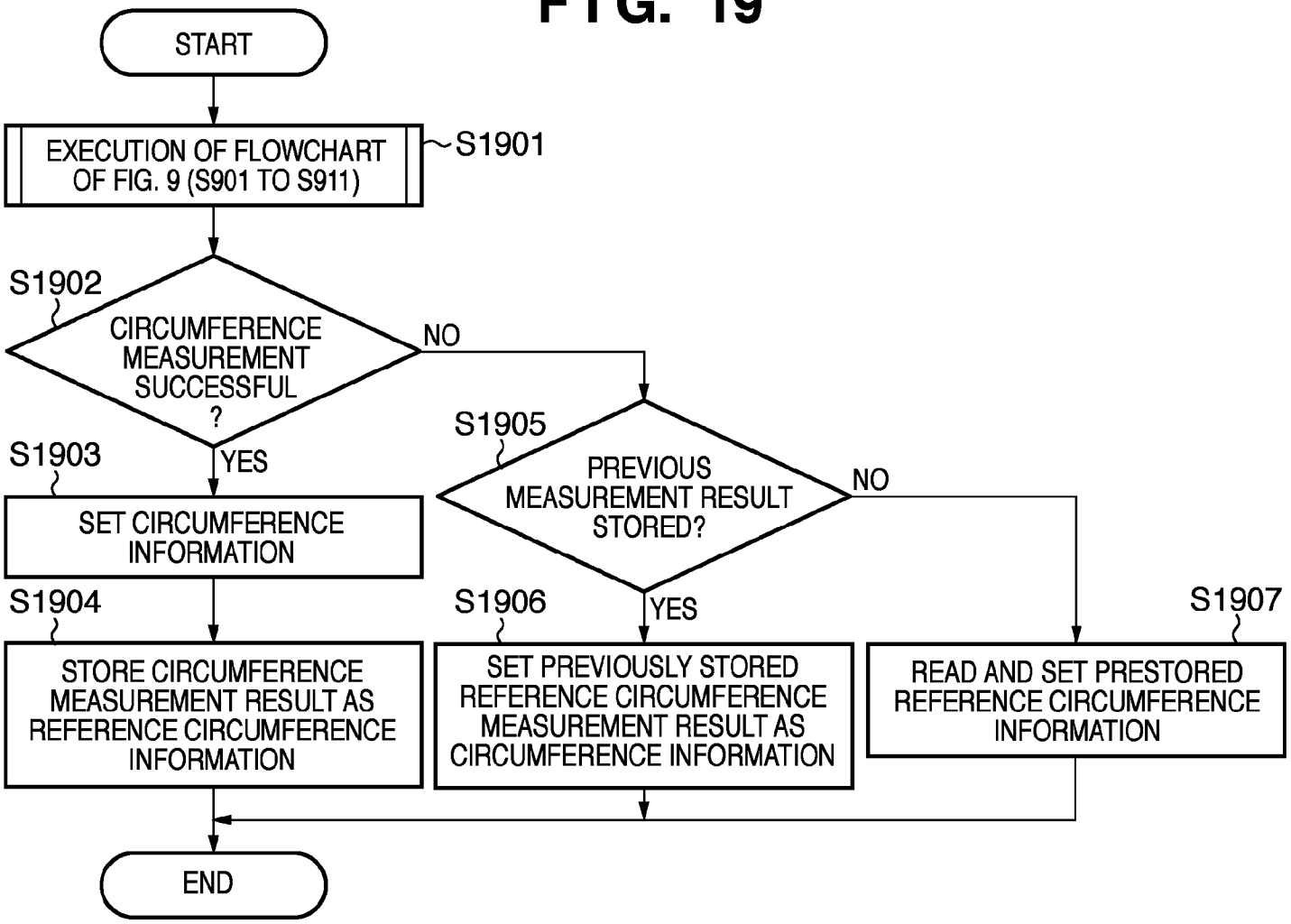
FIG. 19 is a flowchart showing an example of a remeasurement sequence upon a circumference measurement failure according to the first embodiment.

A circumference measurement method upon a circumference measurement failure according to the first embodiment will be explained with reference to the flowchart of FIG. 19. The CPU 101 executes this flowchart and implements it as the circumference measurement unit 111. A reliability determination unit and remeasurement unit included in the circumference measurement unit 111 operate as described with reference to FIG. 2.

In step S1901, the circumference measurement unit 111 executes steps S901 to S911 of FIG. 9 described above. A description of these processes will not be repeated.

In step S911 of FIG. 9, the shift value X which gives a minimum accumulated value of difference absolute values is extracted. In step S1902, the reliability determination unit of the circumference measurement unit 111 determines whether circumference measurement is successful. This determination is made under the condition of the above-described failure example 1 and/or 2 or another condition. When circumference measurement is successful, for example, when the shift value X which gives a minimum accumulated value of difference absolute values falls within the range of 11 to 89 and the ratio between the maximum and minimum accumulated values of difference absolute values exceeds 1.3, the reliability determination unit of the circumference measurement unit 111 determines that the reliability of the circumference detection result is high. In step S1903, the circumference measurement unit 111 obtains circumference information based on the shift value X, and sets it for image density adjustment. In step S1904, the circumference measurement unit 111 stores the circumference measurement result in the RAM 103 or nonvolatile memory 109.

If the shift value X which gives a minimum accumulated value of difference absolute values falls within the range of 0 to 10 or 90 to 100, or the ratio between the maximum and minimum accumulated values of difference absolute values is equal to or lower than 1.3, the reliability determination unit of the circumference measurement unit 111 determines that the reliability of the circumference detection result is low. That is, the reliability determination unit determines not to use information on the circumference obtained by calculation. If the reliability determination unit determines not to use the obtained information on the circumference, the circumference measurement unit 111 determines in step S1905 whether the RAM 103 or nonvolatile memory 109 stores the result of previous circumference measurement.

If the RAM 103 or nonvolatile memory 109 stores the result of previous circumference measurement, the remeasurement unit of the circumference measurement unit 111 performs processing in step S1906 to read the reference circumference result stored in step S1904 in previous measurement, and sets the reference circumference result as circumference information. By the processing of step S1906, information on the circumference can be recalculated.

In every circumference measurement, the RAM 103 or nonvolatile memory 109 stores the result of current circumference measurement as the latest circumference measurement result according to the same sequence. The latest circumference measurement result is used as reference circumference information upon generation of an error. Even if circumference measurement fails, image density calibration control can be executed at high precision without any serious error. Every time circumference measurement is successful, the latest circumference information is updated as new reference circumference information. Even if the installation environment of the apparatus varies, or the circumference changes over time upon long-term operation, the latest circumference information is always updated. This can always provide circumference information at high precision.

In the first embodiment, the latest circumference detection result is stored as new reference circumference information. Alternatively, the nonvolatile memory 109 can also store, for example, circumference information obtained by calculating and averaging pieces of past circumference information. In this case, more accurate reference circumference information can be attained even when belt conveyance states immediately after power-on and after supply of paper differ from each other, or a disturbance occurs, including a temperature rise in the apparatus and an abrupt change of the temperature or humidity near the installation location. More stable image density calibration control can be executed using average data of pieces of recent circumference information.

If the circumference measurement unit 111 determines in step S1905 that no previous circumference measurement result is stored, in step S1907, the remeasurement unit (not shown) of the circumference measurement unit 111 sets, as circumference information, reference circumference information stored in advance in the nonvolatile memory 109.

As the prestored reference circumference information, for example, circumference information in shipping is stored in advance in a storage medium such as a nonvolatile memory in the apparatus, and referred to as reference circumference information. Alternatively, circumference information acquired as the circumference measurement result of the first circumference measurement upon power-on of the apparatus may also be stored as reference circumference information. In the first embodiment, every time the apparatus is turned on, the result of circumference measurement executed upon power-on is stored and used as reference information in circumference measurement.

In this way, even if circumference measurement fails, prestored reference circumference information can be used as circumference information to execute image density calibration control at relatively high precision without any serious error.

The first embodiment uses the image density measurement optical sensor 104 to perform circumference measurement according to the profile circumference detection method (method of obtaining information on the circumference). The same effects as those described above can also be attained by performing profile detection even using a color misregistration detection sensor. The circumference is detected using specularly reflected light. However, depending on the type of image carrier to be measured, the same effects as those described above can also be obtained by detecting the circumference using diffusely reflected light. The profile is calculated by accumulating difference absolute values. Instead, the same effects as those described above can also be achieved by calculating a standard deviation. The profile circumference detection result is used for image density calibration control in the first embodiment, but may also be used for color misregistration calibration control.

More specifically, a case wherein the circumference measurement unit 111 performs calculation based on a standard deviation will be explained by exemplifying the first embodiment. An equation at this time is $$xi = V_{first\ round}(i) - V_{second\ round}(i + X) \tag{5}$$

$$\sigma = \sqrt{\frac{n\sum(V_{first\ round}(i) - V_{second\ round}(i + X))^2 - (\sum(V_{first\ round}(i) - V_{second\ round}(i + X)))^2}{n(n-1)}}$$

where n is the number of samples, and σ is the standard deviation value. Since the number Xi of samples=1,000, n=1,000. The remaining variables have been explained in the first embodiment.

For X=0, 1, 2, . . . , 100, X which gives a minimum σ is extracted. After extracting X, information on the actual circumference is obtained similarly to the first embodiment. It will readily occur to those skilled in the art to apply equation (5) employing the standard deviation to the second to fourth embodiments.

The first embodiment has described an image forming apparatus using an intermediate transfer belt. However, the arrangement according to the present invention is also applicable to a tandem type direct transfer multicolor image forming apparatus (ETB type) which transfers multiple toner images. In the tandem type direct transfer multicolor image forming apparatus, a plurality of image forming units are series-arranged to form toner images of different colors. The toner images are sequentially transferred onto a transfer material such as printing paper carried by a transfer material carrier which is generally a belt.

Second Embodiment

The second embodiment detects an environment (temperature, humidity, or absolute moisture content), and stores a pair of the detected environment as a reference environment and corresponding reference circumference information. In next and subsequent circumference measurement operations, if the reliability determination unit determines that the reliability of information on a measured circumference is low, an environment (temperature, humidity, or absolute moisture content) in circumference measurement is detected. Based on the detected environment, the circumference information is corrected by multiplying, by a correction coefficient corresponding to a change of the environment, the reference circumference information stored in advance in correspondence with the reference environment. The second embodiment uses the corrected circumference information.

The second embodiment will be explained. The arrangement of the image forming apparatus, the structure of the optical sensor, image density calibration control, the algorithm for obtaining circumference information of a rotation member, and determination of a circumference measurement failure are the same as those in the first embodiment, and a description thereof will not be repeated.

An image forming apparatus main body according to the second embodiment includes an environmental sensor (not shown) as an example of the environment detection unit. As an environmental condition for detecting the degree of influence of a disturbance in the image forming apparatus, the environmental sensor detects the temperature, the humidity, the temperature and relative humidity (moisture content $g/m^3$: a content uniquely obtained from the temperature and humidity), or the like. A nonvolatile memory 109 in FIG. 2 stores a pair of measured circumference information and an environment detected upon measurement, or stores in advance a pair of reference circumference information and a reference environment.

[Details of Circumference Measurement Method Upon Circumference Measurement Failure According to Second Embodiment]

Figure 20:
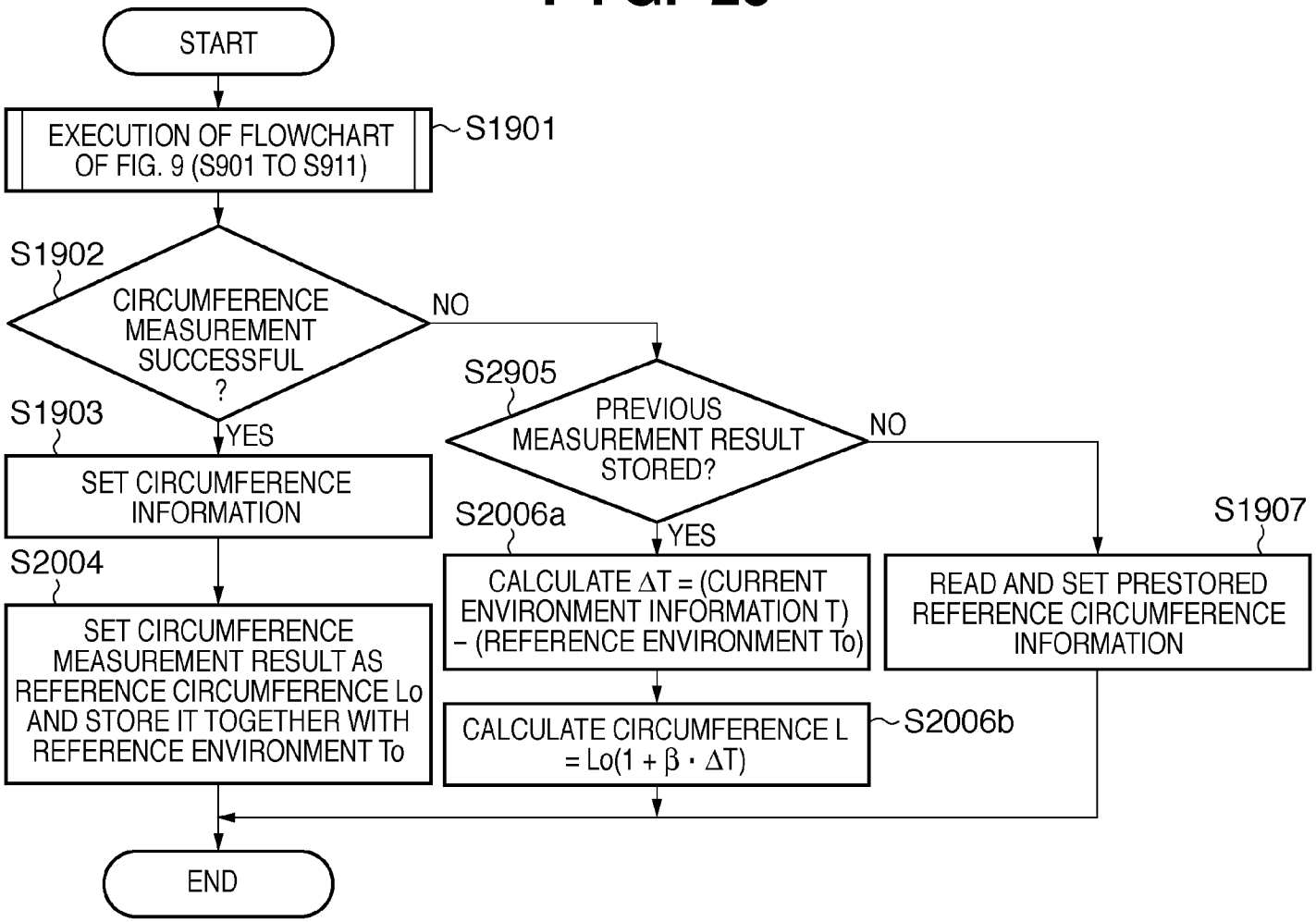
FIG. 20 is a flowchart showing an example of a remeasurement sequence upon a circumference measurement failure according to the second embodiment.

A circumference measurement method upon a circumference measurement failure according to the second embodiment will be explained with reference to the flowchart of FIG. 20. The same step numbers as those in FIG. 19 in the first embodiment denote the same steps. A CPU 101 executes this flowchart and implements it as a circumference measurement unit 111. A reliability determination unit and remeasurement unit included in the circumference measurement unit 111 operate as described with reference to FIG. 2.

In step S1901, the circumference measurement unit 111 executes steps S901 to S911 of FIG. 9 described above. A description of these processes will not be repeated.

In step S911 of FIG. 9, the shift value X which gives a minimum accumulated value of difference absolute values is extracted. In step S1902, the reliability determination unit of the circumference measurement unit 111 determines whether the obtained information on the circumference can be used without any problem, that is, whether circumference measurement is successful. This determination is made under the condition of the above-described failure example 1 and/or 2 or another condition. When circumference measurement is successful, for example, when the shift value X which gives a minimum accumulated value of difference absolute values falls within the range of 11 to 89 and the ratio between the maximum and minimum accumulated values of difference absolute values exceeds 1.3, the reliability determination unit of the circumference measurement unit 111 determines that the reliability of the circumference measurement result is high. In step S1903, the circumference measurement unit 111 obtains circumference information based on the shift value X, and sets it for image density adjustment.

In step S2004, the circumference measurement unit 111 sets the circumference measurement result as a reference circumference L0, and sets environment information detected by the environmental sensor in circumference measurement as a reference environment T0. A RAM 103 or nonvolatile memory 109 stores the reference circumference L0 and reference environment T0. In this case, the reference circumference L0 and corresponding reference environment T0 are stored in correspondence with each other.

If the shift value X which gives a minimum accumulated value of difference absolute values falls within the range of 0 to 10 or 90 to 100, or the ratio between the maximum and minimum accumulated values of difference absolute values is equal to or lower than 1.3, the reliability determination unit of the circumference measurement unit 111 determines that the reliability of the circumference detection result is low. In this case, the circumference measurement unit 111 determines in step S1905 whether the RAM 103 or nonvolatile memory 109 stores the result of previous circumference measurement.

If the RAM 103 or nonvolatile memory 109 stores the result of previous circumference measurement, the process advances to step S2006*a*. In step S2006*a*, the remeasurement unit of the circumference measurement unit 111 calculates the difference ΔT between the current environment information T acquired from the environmental sensor, and the reference environment T0 stored in step S2004 in previous measurement. In step S2006*b*, the remeasurement unit of the circumference measurement unit 111 calculates the circumference L considering a change of the environment in accordance with the reference circumference information L0 stored in step S2004 in previous circumference measurement and the calculated difference ΔT:

$$L=L0(1+\beta\cdot\Delta T) \tag{6}$$

where L is the length, ΔT is a change of the temperature, and β is the linear expansion coefficient. In general, the elongation ΔL is given by $\Delta L=\beta\cdot L\cdot\Delta T$.

In this fashion, the value L corrected in consideration of a change of the environment is calculated as circumference information. Even if previously obtained circumference information is not used, accurate circumference information can be attained. The linear expansion coefficient is a value uniquely determined for the material. For example, when the intermediate transfer member is a polyimide belt, the second embodiment sets the linear expansion coefficient to about 8.0E-0.6.

Circumference information obtained when previous circumference measurement was successful, and environment information in the previous circumference measurement are stored as reference circumference information and reference environment information in one-to-one correspondence. If, for example, circumference measurement fails, a change of the environment is obtained from current environment information and previous environment information. The reference circumference is corrected and used, obtaining more accurate circumference information. Hence, even if circumference measurement fails, image density calibration control can be executed at high precision without any serious error.

The second embodiment stores the linear expansion coefficient in advance and uses it for calculation to perform circumference detection at high precision. However, the circumference change $\Delta L$ in the environment change $\Delta T$ may also be actually calculated from circumferences and pieces of environment information obtained from an arbitrary number of detection results. $\Delta L/AT$ is used as a correction coefficient, and $L=L0(1+\Delta L/\Delta T)$ is used. Also in this case, a high-precision circumference detection result can be obtained. The same effects as those described above can also be obtained even when the environment is divided into a plurality of zones in advance, and reference circumference data is stored for each divided zone. In this case, for example, when circumference detection fails, circumference information corresponding to each zone is referred to and used.

If the circumference measurement unit 111 determines in step S1905 that no previous circumference measurement result is stored, in step S1907, the remeasurement unit of the circumference measurement unit 111 sets, as circumference information, reference circumference information stored in advance in the nonvolatile memory 109.

The second embodiment uses an image density measurement optical sensor 104 to perform circumference measurement according to the profile circumference detection method. The same effects as those described above can also be attained by performing profile detection even using a color misregistration detection sensor. The circumference is detected using specularly reflected light. However, depending on the type of image carrier to be measured, the same effects as those described above can also be obtained by detecting the circumference using diffusely reflected light. The profile is calculated by accumulating difference absolute values. Instead, the same effects as those described above can also be achieved by calculating a moving average or standard deviation. The profile circumference detection result is used for image density calibration control in the second embodiment, but may also be used for color misregistration calibration control.

The second embodiment has described an image forming apparatus using an intermediate transfer belt. However, the arrangement according to the present invention is also applicable to a tandem type direct transfer multicolor image forming apparatus (ETB type) which transfers multiple toner images. In the tandem type direct transfer multicolor image forming apparatus, a plurality of image forming units are series-arranged to form toner images of different colors. The toner images are sequentially transferred onto a transfer material such as printing paper carried by a transfer material carrier which is generally a belt.

Third Embodiment

In the first and second embodiments, when the reliability determination unit determines that the reliability of information on a measured circumference is low, the circumference remeasurement method uses circumference information which has been measured previously and is stored. To the contrary, in the third embodiment, when the reliability determination unit determines that the reliability of information on a measured circumference is low in circumference measurement, information on the circumference of a rotation member is recalculated by acquiring again the waveform profile of the second round in profile circumference detection of the third embodiment.

The third embodiment will be explained. The arrangement of the image forming apparatus, the structure of the optical sensor, image density calibration control, the algorithm for obtaining circumference information of a rotation member, and determination of a circumference measurement failure are the same as those in the first embodiment, and a description thereof will not be repeated.

[Details of Circumference Measurement Method Upon Circumference Measurement Failure According to Third Embodiment]

A circumference measurement method upon a circumference measurement failure according to the third embodiment will be explained with reference to the flowchart of FIG. 21. The flowchart of FIG. 21 can be executed by modifying the flowchart of FIG. 9 in the first embodiment and adding steps. The same step numbers as those in FIG. 9 denote the same steps. A description of the same steps will not be repeated.

In step S2100, a circumference measurement unit 111 initializes, to 1, a variable N for which a RAM 103 ensures an area. In steps S2104 and S2105, the circumference measurement unit 111 performs sampling of 1,000 data in the N-th round and sampling of 1,100 data in the (N+1)-th round. In sampling of the first round N=1, the sampling method is the same as that in the first embodiment.

In steps S2107, the circumference measurement unit 111 accumulates difference absolute values while shifting the shift amount X for the sampling results of the N-th and (N+1)-th rounds in accordance with sampling of the Nth and (N+1)-th rounds. After the end of accumulating difference absolute values at the shift amount X of 0 to 100, the circumference measurement unit 111 detects a shift amount X which gives a minimum accumulated value of difference absolute values, and converts it into circumference information in step S911, similar to the first embodiment.

After step S911, in step S2121, the reliability determination unit of the circumference measurement unit 111 determines, based on the shift amount X which gives a minimum accumulated value of difference absolute values, and the ratio between the maximum and minimum accumulated values of difference absolute values, whether circumference measurement has failed or is successful, similar to the first embodiment. If the reliability determination unit determines that circumference measurement is successful, the process advances to step S912, and the circumference measurement unit 111 saves the finalized circumference.

If the reliability determination unit determines that circumference measurement has failed, the remeasurement unit of the circumference measurement unit 111 increments the variable N by one in step S2122, and the process returns to step S2105. Then, the circumference measurement unit 111 can recalculate information on the circumference of the rotation member.

In step S2105, the circumference measurement unit 111 performs sampling of the next round. In the first remeasurement, the circumference measurement unit 111 executes sampling of the third round. When previous sampling targets the Nth and (N+1)-th rounds, the circumference measurement unit 111 performs sampling of the (N+2)-th round. In the first remeasurement, the circumference measurement unit 111 calculates the difference in step S2107 by sampling of the second and third rounds. When previous sampling targets the Nth and (N+1)-th rounds, the circumference measurement unit 111 calculates the difference in step S2107 by sampling of the (N+1)-th and (N+2)-th rounds. In this manner, in step S2105, sampling of one next round is done for remeasurement. The circumference can be measured based on the sampling results of two final rounds. In the third embodiment, sampling of the third and subsequent rounds and remeasurement of the circumference correspond to processing by the remeasurement unit of the circumference measurement unit 111. In this case, the profile of previous sampling corresponds to at least one pattern, and the profile of new sampling corresponds to the other pattern.

The determination of circumference measurement in step S2121 is repeated until a measurement result with high reliability is attained. A measurement result with high reliability may not be obtained due to a fatal damage to the apparatus. Thus, it is desirable to stop measurement and perform error processing when, for example, the repeat count (corresponding to a value of N−1 after step S2122) exceeds a threshold.

Remeasurement is complete only while the intermediate transfer belt rotates one round after it is determined that circumference measurement has failed. Hence, the third embodiment can shorten the measurement time.

The third embodiment uses an image density measurement optical sensor 104 to perform circumference measurement according to the profile circumference detection method. The same effects as those described above can also be attained by performing profile detection even using a color misregistration detection sensor. The circumference is detected using specularly reflected light. However, depending on the type of image carrier to be measured, the same effects as those described above can also be obtained by detecting the circumference using diffusely reflected light. The profile is calculated by accumulating difference absolute values. Instead, the same effects as those described above can also be achieved by calculating a moving average or standard deviation. The profile circumference detection result is used for image density calibration control in the third embodiment, but may also be used for color misregistration calibration control.

The third embodiment has described an image forming apparatus using an intermediate transfer belt. However, the arrangement according to the present invention is also applicable to a tandem type direct transfer multicolor image forming apparatus (ETB type). In the tandem type direct transfer multicolor image forming apparatus, a plurality of image forming units are series-arranged to form toner images of different colors. The toner images are sequentially transferred onto a transfer material such as printing paper carried by a transfer material carrier which is generally a belt.

The arrangement according to the present invention is also applicable to an arrangement which executes image density calibration control on a photosensitive drum.

Fourth Embodiment

In the fourth embodiment, similar to the third embodiment, the profile is detected again. At this time, the fourth embodiment changes the position where sampling is executed.

The arrangement of the image forming apparatus, the structure of the optical detection sensor, image density calibration control, and the algorithm for obtaining circumference information of a rotation member according to the fourth embodiment are the same as those in the first embodiment, and a description thereof will not be repeated.

[Details of Circumference Measurement Method Upon Circumference Measurement Failure According to Fourth Embodiment]

Figure 22:
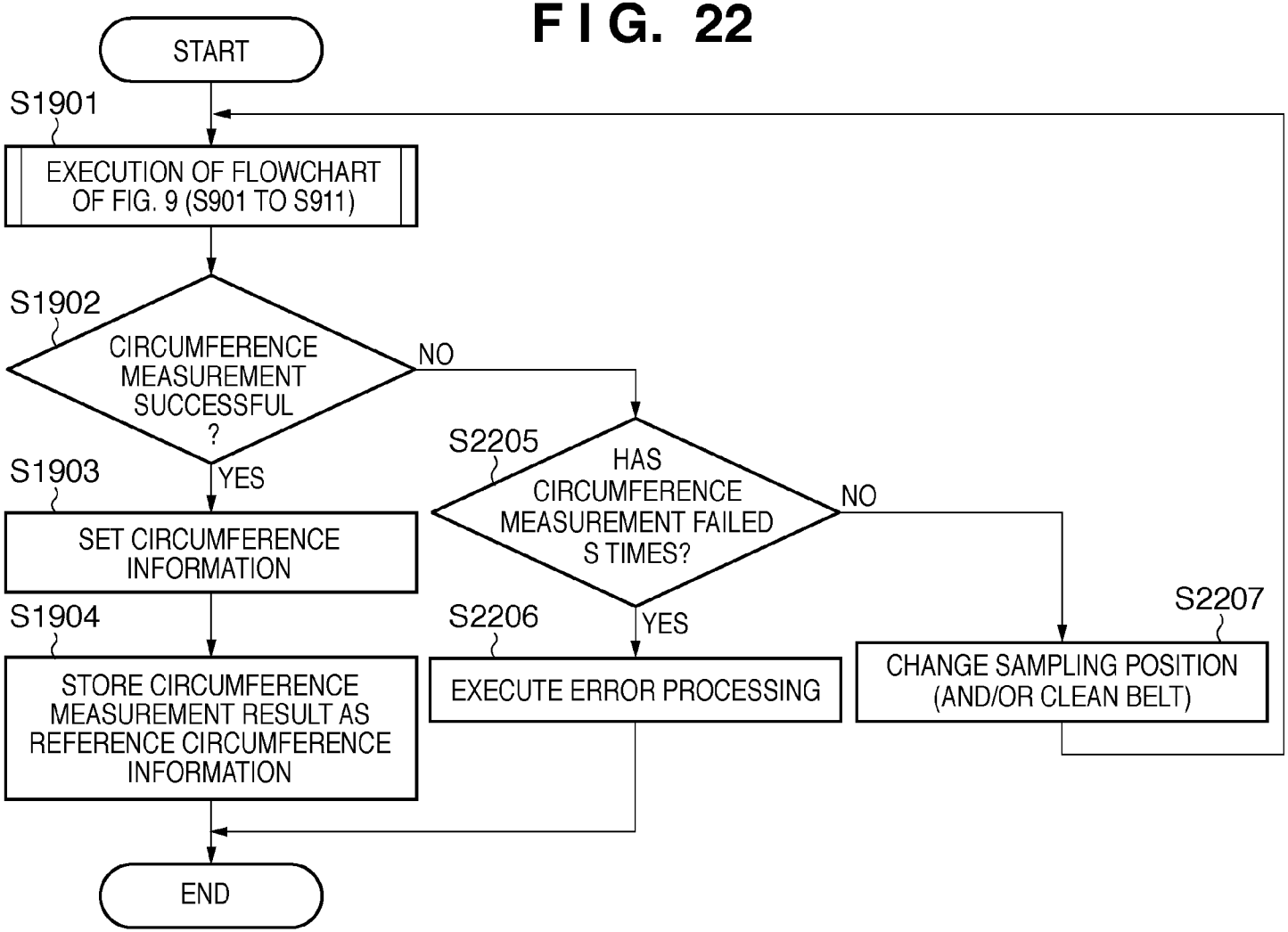
FIG. 22 is a flowchart showing an example of a remeasurement sequence upon a circumference measurement failure according to the fourth or fifth embodiment.

A circumference measurement method upon a circumference measurement failure according to the fourth embodiment will be explained with reference to the flowchart of FIG. 22. A sequence when circumference detection is successful is the same as the processing of FIG. 19 in the first embodiment.

In step S1901, a circumference measurement unit 111 executes steps S901 to S911 of FIG. 9 described above. A description of these processes will not be repeated. In step S911 of FIG. 9, the shift value X which gives a minimum accumulated value of difference absolute values is extracted. In step S1902, the reliability determination unit of the circumference measurement unit 111 determines whether circumference measurement is successful. If the reliability determination unit of the circumference measurement unit 111 determines that the reliability of the circumference detection result is high, the circumference measurement unit 111 obtains circumference information based on the shift value X, and sets it for image density adjustment in step S1903. In step S1904, the circumference measurement unit 111 stores the circumference measurement result in a RAM 103 or nonvolatile memory 109.

If the reliability determination unit of the circumference measurement unit 111 determines in step S1902 that the reliability of the circumference detection result is low, the process advances to step S2205. In step S2205, the reliability determination unit of the circumference measurement unit 111 determines whether the number of circumference measurement failures has reached S. A counter (not shown) in the RAM 103 counts the number of circumference measurement failures. The threshold S is set to the repeat count used to estimate that no reliable measurement result is obtained owing to a fatal damage to the apparatus. In the fourth embodiment, the sampling period is set to about ⅛ of the circumference of the intermediate transfer member, so S=8 suffices. If the reliability determination unit determines in step S2205 that the number of circumference measurement failures has reached S, the circumference measurement unit 111 stops measurement of the circumference and executes error processing in step S2206. In step S2206, it is also possible to notify an error and continue subsequent processing using a circumference stored in advance, similar to the first and second embodiments.

If the number of circumference measurement failures is smaller than S in step S2205, the remeasurement unit of the circumference measurement unit 111 advances to step S2207. In step S2207, the remeasurement unit of the circumference measurement unit 111 counts up the number of circumference measurement failures. Then, the remeasurement unit changes the sampling position from the previous one, and executes next circumference measurement. The sampling position change method will not be explained in detail. However, this can be achieved by obtaining, from the nominal circumference, a position to which the range of 1,100 sampling points is shifted in this example, so that the sampling position does not overlap the previous one.

The fourth embodiment provides a remeasurement method effective for a case wherein the sampling result of circumference measurement does not stabilize owing to, for example, a serious damage to only a specific area on the intermediate transfer member as a reason for a circumference measurement failure. Sampling of two rounds is executed again after it is determined that circumference measurement has failed.

Thus, even if measurement starts while the traveling state such as the approach of the intermediate transfer member is unstable, a sufficient time can be ensured until traveling stabilizes till remeasurement, unlike the third embodiment.

Fifth Embodiment

In the fifth embodiment, an intermediate transfer member is cleaned before executing remeasurement in order to detect a profile again in the processing of step S2207 to change the sampling position in the fourth embodiment after it is determined that circumference measurement has failed.

Processing except for cleaning is the same as that in the fourth embodiment, and a description thereof will not be repeated.

A cleaning blade 33 in FIG. 1 serving as a cleaning unit can completely recover toner remaining after transfer when the print ratio of an image is about 10% to 25% and toner remains by about 20% at most after secondary transfer. The blade scrapes toner from the belt. If a large amount of toner remains at once, the toner cannot be completely recovered, remains slightly, and passes through the gap between the belt and the blade. For example, when a jam occurs and no image is transferred to paper during printing of a solid image in which two or more colors are applied to the entire surface, a very large amount of toner is supplied to the cleaning blade, and a large amount of toner passes through the gap.

If toner has passed through the gap between the belt and the blade, a large amount of toner has already stayed near the blade. Even when the belt rotates one round and cleaning is executed again, a cleaning error may occur again, and the toner may pass through the gap. In this case, cleaning needs to be done by rotating the belt about two or three rounds, or about five rounds in a severe situation in which the blade rubber gets hard, like a 0° C. environment, until the toner is completely scraped. From this, the fifth embodiment sets the failure threshold S is set to about 6.

The circumference detection result becomes unstable and an error highly likely occurs in the situation in which toner is adhered to the belt owing to a cleaning error, and every time the belt passes through the cleaning blade, toner on the belt decreases. In this situation, it is effective to repetitively clean the belt before executing remeasurement.

The fifth embodiment is particularly effective for a case wherein the reason for a circumference detection failure is toner remaining on the intermediate transfer member after cleaning. After it is determined that circumference detection has failed, sampling of two rounds is executed similarly to the fourth embodiment. Thus, when detection starts while the traveling state such as the approach of the intermediate transfer member is unstable, a sufficient time can also be ensured until traveling stabilizes. In addition to toner left after cleaning, contamination on the belt includes a fingerprint generated when the user touches the belt surface, contamination by oil such as grease, and contamination by toner which scatters in the apparatus and is adhered to the belt. The fifth embodiment provides a remeasurement method effective for a case wherein such contaminations cause a detection error.

A combination of the fourth and fifth embodiments can implement more effective remeasurement. For example, remeasurement is done while performing cleaning several times. If a measurement result with high reliability cannot be obtained, the sampling position can also be changed. In step S2207 of FIG. 22, both cleaning and a change of the sampling position may also be performed. Such combinations can also be changed depending on the environment where the image forming apparatus is used.

As resampling, remeasurement processes in the third to fifth embodiments can also be combined. As a simple example, remeasurement according to the third embodiment is repeated a predetermined number of times. If a measurement result with high reliability cannot be obtained, the processes according to the fourth and fifth embodiments are performed. This may also be repeated. When the third to fifth embodiments are combined, the third embodiment can measure a circumference at high reliability within a short time as long as the intermediate transfer member is stable and is not contaminated. The fourth and fifth embodiments can measure a circumference with high reliability even if the intermediate transfer member is unstable or is contaminated.

The third to fifth embodiments have exemplified profile detection as circumference detection. The profile detection method detects a small change of the background of the belt or the like, and may fail in detection owing to even slight contamination of the belt or the like. Even if the first detection fails, redetection is highly likely successful. Thus, the arrangement according to the present invention is very effective for increasing the precision of density detection and the like.

The arrangement of the present invention for executing redetection, like the third to fifth embodiments, is not limited to only profile detection. For example, this arrangement is also effective for a conventional method. According to the conventional method, a mark for detecting a circumference is attached to an intermediate transfer member. An optical sensor receives light reflected by the mark to measure the circumference. The arrangement is also effective for a method of printing a patch on an electrostatic attraction conveyance belt, and measuring the circumference of the electrostatic attraction conveyance belt.

Sixth Embodiment

In the above-described embodiments, waveform data based on sampling results in the first round of a rotation member are 1,000 data, and those based on sampling results in the second round are 1,100 data. In other words, the detection time of one waveform data acquired based on sampling in the first round is longer than that of the other waveform data acquired based on sampling in the second round. However, the waveform data are not limited to them. For example, the relationship between waveform data may also be reversed from that in the embodiments. That is, the detection time of one waveform data acquired based on sampling in the second round may also be longer than that of the other waveform data acquired based on sampling in the first round.

In this case, calculation of information on the actual circumference of a rotation member will be explained mainly for a difference from the first embodiment with reference to FIG. 9 for an intermediate transfer belt 31 serving as a typical example of a rotation member.

Processes corresponding to steps S901 to S903 are executed.

Then, in a process corresponding to step S904, a circumference measurement unit 111 executes sampling of the first round from an arbitrary position for the output value of reflected light received by a light receiving element 302. At the same time as the start of sampling of the first round, the circumference measurement unit 111 starts a timer for deciding the sampling start timing of the second round. At this time, the number of sampling points in the first round is 1,100 in correspondence with a shift amount of 100 points, unlike the first embodiment. The sixth embodiment is different from the above-described embodiments in how to adjust a predetermined time from a predetermined reference time necessary for the intermediate transfer belt 31 to rotate one round by using the waveform data detection timing of the first round as a reference. More specifically, a value obtained by adding half the maximum circumference change amount to the nominal circumference is set in the timer.

However, similar to the above-described embodiments, waveform data of the second round is sampled so that the section of the image-formed surface of one of the waveform data of the first and second rounds falls within the section of the image-formed surface corresponding to the other waveform data. Also similar to the above-described embodiments, when the circumference measurement unit 111 acquires two waveform data from a RAM 103, a section of the image-formed surface that corresponds to one waveform data falls within a section of the image-formed surface that corresponds to the other waveform data.

Referring back to the flowchart, if the timer has reached the set value, sampling of the waveform profile of the second round starts in a process corresponding to step S905. At this time, the number of sampling points in the second round is 1,000 in the fourth embodiment, unlike 1,100 in the first embodiment.

After executing a process corresponding to step S906 similarly to the first embodiment, processes corresponding to steps S907 to S909 continue until YES is determined in a process corresponding to step S910.

At this time, difference absolute values between waveform data (corresponding to the third waveform data) extracted from the waveform profile of the first round and the waveform profile of the second round are accumulated:

$$I(X) = \sum_{i=1}^{1000} |V_{second\ round}(i) - V_{first\ round}(i + X)| \tag{7}$$

Similar to the first embodiment, X=0, 1, 2, . . . , 100.

In a process corresponding to step S911, the circumference measurement unit 111 determines a minimum value among a plurality of calculated accumulated values I(X). The actual circumference can be calculated using an X value which gives a minimum accumulated value:

$$\text{actual circumference}=((100-X_{profile\ result})-X_{ITB\ ideal}))*0.1+\text{nominal circumference} \tag{8}$$

In a process corresponding to step S912, a density calibration control unit 112 of a CPU 101 executes image density calibration control based on information on the actual circumference that has been calculated by equation (8).

As described above, even when waveform data corresponding to a long detection time is acquired in sampling of the first round, like the sixth embodiment, the same effects as those of the above-described embodiments can be obtained.

The first to sixth embodiments reveal the following fact. More specifically, two acquired waveform data are defined as the first and second waveform data. One of the waveform data is set as reference waveform data. Waveform data which matches the reference waveform data is extracted from the other waveform data. Interval information corresponding to the interval between the reference waveform data and the extracted waveform data is obtained, attaining information on the actual circumference.

Other Embodiments

As another embodiment, the present invention is also applicable to an image forming apparatus (ETB type) which employs a tandem type direct transfer method. According to the tandem type direct transfer method, a plurality of image forming stations are series-arranged to form toner images of different colors. The toner images are sequentially transferred onto a printing material such as printing paper. The control arrangement of the image forming apparatus, the structure of the optical detection sensor, image density calibration control, and the algorithm for obtaining circumference information of a rotation member are the same as those in the above-described embodiments, and a description thereof will not be repeated. As still another embodiment, the present invention is also applicable to an image forming apparatus which performs image density calibration control on a photosensitive drum.

The present invention is not limited to the above-described embodiments, and can be variously modified. For example, the first to fifth embodiments execute circumference measurement using an optical sensor for density calibration control. However, the present invention may measure the circumference of a rotation member using a color misregistration detection sensor as an optical sensor for circumference measurement. The circumference is measured using specularly reflected light. However, depending on the type of rotation member to be measured, the circumference may also be measured using diffusely reflected light. The waveform profile is calculated by accumulating difference absolute values. Instead, the circumference of a rotation member may also be obtained by calculating a standard deviation. The measured circumference of a rotation member is used for image density calibration control in the above-described embodiments, but may also be used for color misregistration calibration control.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-138782 filed May 27, 2008, which is hereby incorporated by reference herein in its entirety.

What is claimed is:

1. An image forming apparatus comprising:

a rotation member which is used for image forming or carries a printing medium;

a detector adapted to detect light from said rotation member;

a first acquisition unit adapted to acquire first waveform data from a surface of said rotation member based on detection by said detector;

a second acquisition unit adapted to acquire second waveform data from the surface of said rotation member based on detection by said detector, the second waveform data being detected from at least part of a detected section of the surface of said rotation member on which the first waveform data has been detected;

a calculator adapted to calculate information on a circumference of said rotation member based on matching between the acquired first waveform data and second waveform data; and a determination unit adapted to determine whether or not to use the calculated information on the circumference by comparing the acquired first waveform data and second waveform data, wherein when said determination unit determines not to use the calculated information on the circumference, prestored information on the circumference of said rotation member that was stored before the calculation by said calculator is used, and wherein the prestored information includes a fixed value which is not updated, or information based on the information on the circumference of said rotation member that has been calculated by said calculator in a previous calculation.

2. The apparatus according to claim 1, wherein the surface of said rotation member comprises an image-formed surface used for image formation.

3. The apparatus according to claim 1, wherein said determination unit determines whether or not to use the calculated information on the circumference, based on one of a difference and a ratio between an evaluation value obtained when the first waveform data and second waveform data respectively acquired by said first acquisition unit and said second acquisition unit match each other, and an evaluation value obtained when the first waveform data and second waveform data do not match each other.

4. The apparatus according to claim 1, wherein said determination unit determines not to use the calculated information on the circumference, when the first waveform data and the second waveform data match each other in a predetermined range.

5. The apparatus according to claim 1, wherein the circumference of said rotation member that has been calculated by said calculator in the previous calculation comprises information based on pieces of information on the circumference of said rotation member that have been calculated by said calculator in a plurality of calculations.

6. The apparatus according to claim 1, further comprising an environment detection unit adapted to detect environment information on said image forming apparatus, wherein the prestored information includes the information on the circumference of said rotation member that is calculated by said calculator, and environment information obtained when the information on the circumference is calculated, and wherein said calculator calculates, when said determination unit determines not to use the calculated information on the circumference, information on the circumference of said rotation member based on the prestored information on the circumference of said rotation member, the prestored environment information, and environment information newly detected by said environment detection unit.

7. The apparatus according to claim 1, wherein said calculator includes an extraction unit adapted to set one of the first waveform data and the second waveform data as reference waveform data, and extract, from the other waveform data, waveform data determined to match the reference waveform data in matching processing, and calculates interval information corresponding to an interval between the reference waveform data and the waveform data extracted by said extraction unit as the information on the circumference of said rotation member.

8. The apparatus according to claim 7, wherein the interval information corresponding to the interval between the reference waveform data and the extracted waveform data represents a shift amount of the waveform data extracted by said extraction unit from a predetermined reference.

9. The apparatus according to claim 1, further comprising:

a forming unit adapted to form a patch image on said rotation member to perform density calibration control for image forming; and a setting unit adapted to set image forming conditions, wherein said setting unit adjusts the image forming conditions based on a detection result of a quantity of light coming from the patch image by said detector, and the calculated information on the circumference of said rotation member.

10. A method of controlling an image forming apparatus including a rotation member which is used for image forming or carries a printing medium and a detector adapted to detect light from the rotation member, said method comprising:

a first acquisition step of acquiring first waveform data of a surface of the rotation member based on detection by the detector;

a second acquisition step of acquiring second waveform data of the surface of the rotation member based on detection by the detector, the second waveform data being detected from at least part of a detected section of the surface of the rotation member on which the first waveform data has been detected;

a calculation step of calculating information on a circumference of the rotation member based on matching between the acquired first waveform data and second waveform data; and a determination step of determining whether or not to use the calculated information on the circumference by comparing the acquired first waveform data and second waveform data, wherein, when said determination step determines not to use the calculated information on the circumference, prestored information on the circumference of the rotation member that was stored before said calculation step is used, and wherein the prestored information includes a fixed value which is not updated, or information based on the information on the circumference of the rotation member that has been calculated in a previous calculation step.

11. A computer-readable storage medium storing a program for causing a computer to execute the steps of a method of controlling an image forming apparatus according to claim 10.

12. The apparatus according to claim 1, wherein the prestored information on the circumference of said rotation member is stored in a storage unit.

* * * * *